US007620347B2

(12) United States Patent
Okabe

(10) Patent No.: US 7,620,347 B2
(45) Date of Patent: Nov. 17, 2009

(54) DEVELOPING DEVICE AND IMAGE FORMING APPARATUS HAVING A GEAR HOLDER

(75) Inventor: Yasushi Okabe, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/808,332

(22) Filed: Jun. 8, 2007

(65) Prior Publication Data

US 2007/0237549 A1 Oct. 11, 2007

Related U.S. Application Data

(60) Continuation of application No. 10/985,903, filed on Nov. 12, 2004, now Pat. No. 7,460,816, which is a division of application No. 10/397,371, filed on Mar. 27, 2003, now Pat. No. 6,823,160.

(30) Foreign Application Priority Data

Apr. 2, 2002 (JP) ..... 2002-100343

(51) Int. Cl.
*G03G 15/08* (2006.01)

(52) U.S. Cl. ..... 399/119; 399/222

(58) Field of Classification Search ..... 399/222, 399/111, 262, 119
See application file for complete search history.

(56) References Cited

U.S. PATENT DOCUMENTS 4,878,088 A 10/1989 Nakanishi et al.
5,953,569 A 9/1999 Ishikawa
6,029,027 A 2/2000 Yokomori et al.
6,041,203 A 3/2000 Suzuki et al.
6,061,537 A * 5/2000 Nakajima et al. ..... 399/107
6,118,960 A * 9/2000 Nakagawa et al. ..... 399/111
6,212,343 B1 4/2001 Hosokawa et al.
6,246,849 B1 6/2001 Yokoyama et al.
6,463,242 B1 10/2002 Kojima et al.
6,496,667 B2 12/2002 Shiratori et al.
6,496,669 B2 12/2002 Sato et al.
6,507,386 B2 1/2003 Inomata
6,751,428 B2 6/2004 Okabe
6,795,673 B2 9/2004 Yoshizawa
6,816,692 B1 11/2004 Kerley et al.
7,085,519 B2 8/2006 Makino
7,116,919 B2 * 10/2006 Ishii ..... 399/12
7,162,181 B2 * 1/2007 Maeshima et al. ..... 399/109
7,266,327 B2 * 9/2007 Mori et al. ..... 399/111
2001/0028806 A1 * 10/2001 Makino ..... 399/53

(Continued)

FOREIGN PATENT DOCUMENTS

JP A-4-340975 11/1992

(Continued)

*Primary Examiner*—Quana M Grainger
(74) *Attorney, Agent, or Firm*—Oliff & Berridge, PLC

(57) ABSTRACT

An image forming apparatus includes a developing cartridge having a developing roller driven by developing roller drive gear, a supply roller driven by a supply roller drive gear, an input gear, a gear holder formed with a developing roller support member, supply roller support member and input gear support member, a gear holder integrally formed with the support members and a shaft receiving member formed at a location opposite the gear holder.

12 Claims, 13 Drawing Sheets

U.S. PATENT DOCUMENTS

| | | | | |
|---|---|---|---|---|
| 2003/0012588 | A1* | 1/2003 | Suzuki et al. | 399/281 |
| 2005/0117935 | A1* | 6/2005 | Hoshi et al. | 399/111 |
| 2006/0029418 | A1* | 2/2006 | Ishii et al. | 399/111 |
| 2006/0171739 | A1* | 8/2006 | Nakaya | 399/119 |

FOREIGN PATENT DOCUMENTS

| | | | |
|---|---|---|---|
| JP | A-6-130745 | | 5/1994 |
| JP | A 7-181797 | | 7/1995 |
| JP | A-2000-075661 | A | 3/2000 |
| JP | A-2001-042643 | A | 2/2001 |
| JP | A-2001-075346 | | 3/2001 |
| JP | A-2001-83801 | | 3/2001 |

* cited by examiner

DEVELOPING DEVICE AND IMAGE FORMING APPARATUS HAVING A GEAR HOLDER

CROSS-REFERENCE TO RELATED APPLICATIONS

This is a Continuation of application Ser. No. 10/985,903, filed Nov. 12, 2004 which is a Division of application Ser. No. 10/397,371, filed Mar. 27, 2003 which issued as U.S. Pat. No. 6,823,160 on Nov. 23, 2004. The disclosure of the prior applications is hereby incorporated by reference herein in its entirety.

BACKGROUND OF THE INVENTION

1. Field of Invention

The present invention is related to a developing device and an image forming apparatus having the developing device such as a laser printer.

2. Description of Related Art

In a laser printer disclosed in U.S. Pat. No. 6,041,203, a developing cartridge storing toner is detachably mounted in the printer. The developing cartridge includes a toner box for storing toner and a developing roller for bearing a thin layer of toner. An agitator is arranged in the toner box for agitating and transporting the toner.

A supply roller is arranged in the developing cartridge for supplying the toner that is transported from the agitator to the developing roller. The agitator, the supply roller and the developing roller are arranged rotatably.

The developing cartridge further comprises a gear mechanism for transmitting driving force to the developing roller, the supply roller and the agitator.

SUMMARY OF THE INVENTION

The invention provides a developing device and an image forming apparatus wherein the relative positions of a developing roller drive gear, supply roller drive gear and an input gear can be determined with precision and more particularly, to a developing device and an image forming apparatus wherein the relative positions of a developing roller and supply roller can be determined with high precision.

According to one aspect of the invention, a developing device is provided with a housing and a separate holder, mounted to an outside sidewall of the housing, integrally formed with supports that support a developing roller and a supply roller.

Accordingly, the developing device and image forming apparatus are driven stably and the contact condition of the developing roller and supply roller is also stable, and thus, image quality is improved.

BRIEF DESCRIPTION OF THE DRAWINGS

A preferred embodiment of the invention will be described in detail with reference to the following figures wherein.

DETAILED DESCRIPTION OF PREFERRED EMBODIMENTS

Embodiments of the invention will be described below with reference to the accompanying drawings.

Figure 1:
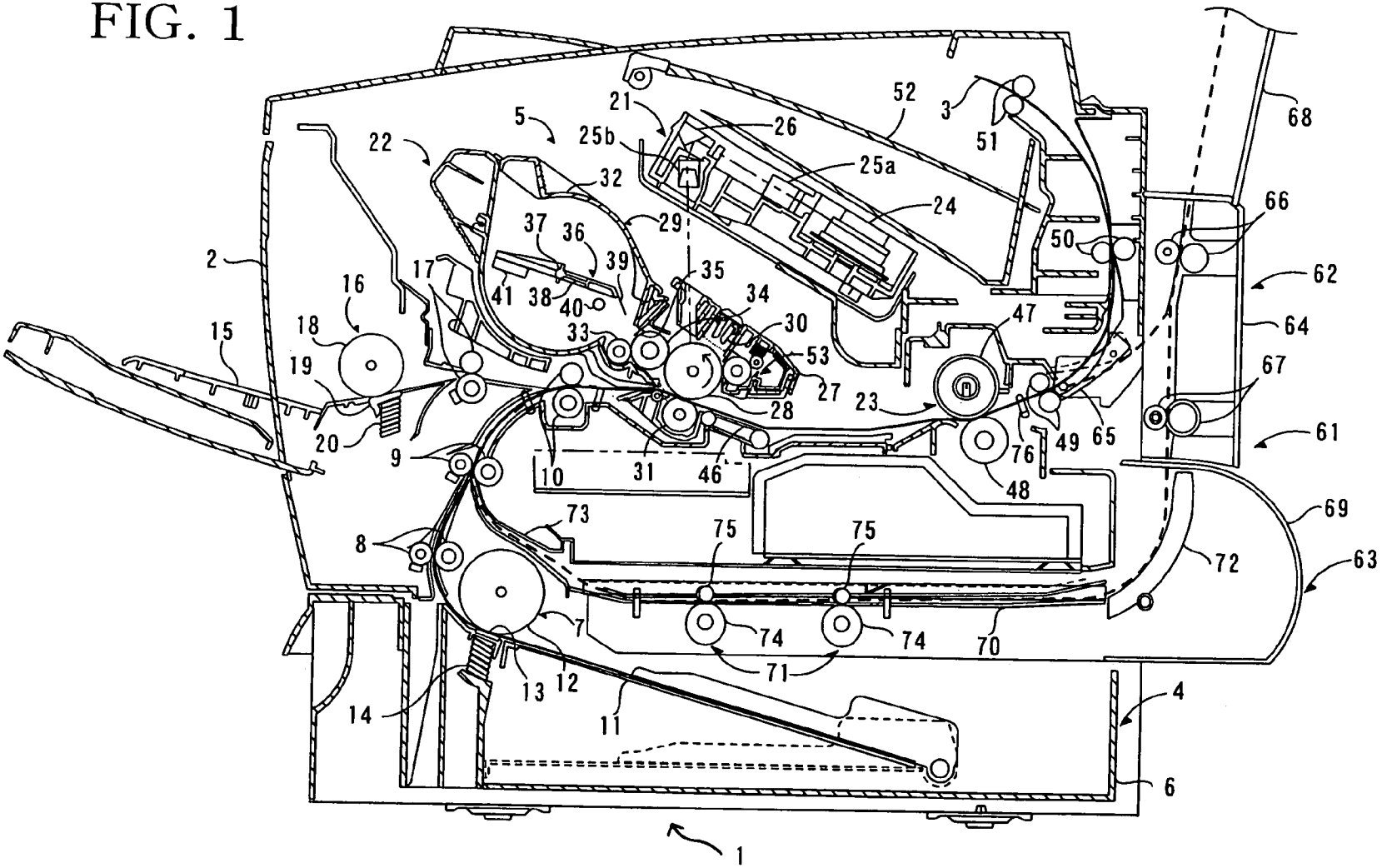
FIG. 1 is a cross sectional view of a main portion of a laser printer according to one embodiment.

FIG. 1 is a cross sectional view of a main portion of a laser printer according to one embodiment.

In a laser printer 1 using an electrophotographic method shown in FIG. 1, images are formed by a developing method using a positive charged non-magnetic one component polymerized toner. A feeder portion 4 for supplying a paper 3 and an image forming portion 5 for forming an image on the supplied paper 3 are arranged in a casing 2 of the laser printer 1.

The feeder portion 4 comprises a supply tray 6, a paper supply mechanism 7, transporting rollers 8, 9 and a resist roller 10. The supply tray 6 is arranged detachably on a bottom portion of the casing 2. The paper supply mechanism 7 is arranged on one end of the supply tray 6. The transporting rollers 8, 9 are arranged on a lower stream side of a paper 3 transporting direction with respect to the paper supply mechanism 7. The resist roller 10 is arranged on a lower stream side of the paper 3 transporting direction with respect to the transporting rollers 8, 9.

The supply tray 6 is formed in a box whose upper side is open for stacking papers 3 therein and detachable from the bottom portion of the casing 2 in a horizontal direction. A paper pressing plate 11 is arranged in the supply tray 6. The papers 3 are stacked on the paper pressing plate 11. The paper pressing plate 11 is supported by its end portion that is far from the paper supply mechanism 7 so as to swing and the end portion of the pressing plate 11 that is closer to the paper supply mechanism 7 moves up and down. The paper pressing plate 11 is urged upwardly from its rear side by a spring (not shown). The paper pressing plate 11 swings around its end portion that is far from the paper supply mechanism 7 downwardly against urging force of the spring, as the amount of the papers 3 is increased.

The paper supply mechanism 7 comprises a supply roller 12, a separation pad 13 that faces the supply roller 12, and a spring 14 that is arranged at a rear side of the separation pad 13. The separation pad 13 is pressed toward the supply roller 12 by the urging force of the spring 14.

A top paper 3 of the stacked papers on the paper pressing plate 11 is pressed toward the supply roller 12 from the rear side of the paper pressing plate 11 by the spring. When the supply roller 12 is rotated, the top paper 3 is held between the supply roller 12 and the separation pad 13 and the papers are separated one by one to be supplied. The supplied paper 3 is transported to the resist roller 10 by the transporting rollers 8, 9.

The resist roller 10 includes a pair of rollers and corrects diagonal feeding of the paper 3 and transports the paper 3 to an image forming position.

The feeder portion 4 includes a manual tray 15 for stacking papers of any size, a manual paper supply mechanism 16 for supplying the papers 3 stacked on the manual tray 15 and a manual transporting roller 17.

The manual paper supply mechanism 16 includes a manual paper supply roller 18, a manual separation pad 19 that faces the manual paper supply roller 18 and a spring 20 that is arranged at a rear side of the manual separation pad 19. The manual separation pad 19 is pressed toward the manual paper supply roller 18 by the urging force of the spring 20.

A top paper 3 of the stacked papers in the manual tray 15 is held between the manual paper supply roller 18 and the manual separation pad 19 by rotation of the manual paper supply roller 18 and the papers 3 are separated one by one to be supplied. The supplied paper 3 is transported to the resist roller 10 by the manual transporting roller 17.

The image forming portion 5 includes a scanner 21, a process unit 22 and a fixing portion 23.

The scanner 21 is arranged at an upper portion in the casing 2 and includes a laser emission portion (not shown), a polygon mirror 24 that is rotated, lenses 25*a*, 25*b* and a reflection mirror 26. A laser beam that is emitted from the laser emission portion based on image data passes through or is reflected by the polygon mirror 24, the lens 25*a*, the reflection mirror 26 and the lens 25*b* in this order as shown by a dotted line and the laser beam is irradiated to a surface of a photosensitive drum 28.

Figure 2:
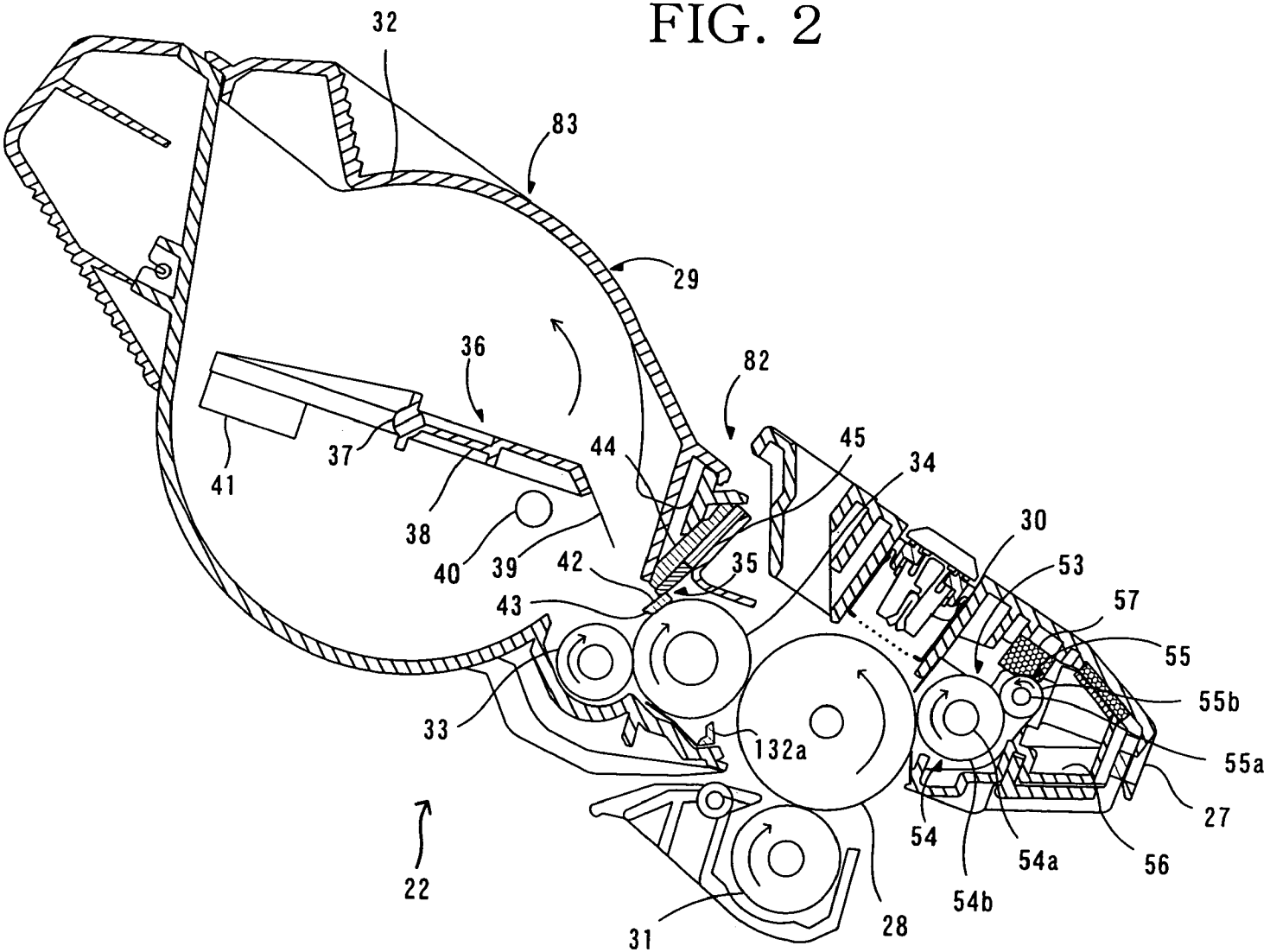
FIG. 2 is a cross sectional view of a process unit.

The process unit 22 is arranged at a lower side of the scanner 21 and mounted detachably in the casing 2. As shown in FIG. 2, a drum frame 27 of the process unit 22 includes a photosensitive drum 28, a developing cartridge 29 that serves as a developing device, a scorotron type charger 30, a transfer roller 31 and a cleaning unit 53.

The developing cartridge 29 is mounted detachably in the drum frame 27 and includes a toner hopper 32, a supply roller 33 that is arranged at a side of the toner hopper 32, a developing roller 34 and a layer thickness restricting blade 35.

The positive charged non-magnetic one component polymerized toner is stored in the toner hopper 32 as a developer. The polymerized toner is obtained by copolymerizing polymerization monomer such as styrene monomer or acrylic monomer such as acryl acid, alkyl (C1-C4) acrylate, and alkyl (C1-C4) methaacrylate by a known polymerization method such as suspension polymerization. An average particle diameter of the polymerization toner is approximately 6-10 μm.

The polymerized toner is almost spherical and superior in fluidity. A coloring agent such as carbon black or wax is mixed with the polymerization toner and an additive such as silica is added to the polymerization toner for improving fluidity.

An agitator 36 is arranged in the toner hopper 32. The agitator 36 includes a rotational shaft 37, an agitating plate 38 and a film 39. The rotational shaft 37 is supported rotatably at the center of the toner hopper 32. The agitating plate 38 is fixed to the rotational shaft 37 and extended therefrom. The film 39 is stuck to a free end of the agitating plate 38. When the rotational shaft 37 is rotated in a direction of an arrow (a counterclockwise direction), the agitating plate 38 moves around the rotational shaft 37 and the film 39 moves the toner in the toner hopper 32 upwardly and transports the toner to the supply roller 33.

A cleaner 41 is arranged at an opposite side to the agitating plate 38 with respect to the rotational shaft 37. When the rotational shaft 37 is rotated, the cleaner 41 cleans a window 40 that is arranged on a side wall of the toner hopper 32.

The supply roller 33 is arranged at a side of the toner hopper 32 so as to be rotatable in a direction of an arrow (a clockwise direction). The supply roller 33 is formed by covering a metal roller shaft 33*a* with a roller portion 33*b* of a conductive urethane foaming material.

The developing roller 34 is arranged at a side of the supply roller 33 so as to be rotatable in a direction of an arrow (a clockwise direction). The developing roller 34 is formed by covering a metal roller shaft 34*a* with a roller portion 34*b* of a conductive elastic material.

The roller portion 34*b* is obtained by covering a surface of conductive urethane rubber or conductive silicon rubber containing carbon fine particles with a coating layer of urethane rubber or silicone rubber containing fluorine.

Developing bias is applied to the roller shaft 34*a* of the developing roller 34 for generating a predetermined potential difference between the developing roller 34 and the photosensitive drum 28.

The supply roller 33 and the developing roller 34 are arranged so that the supply roller 33 contacts and presses the developing roller 34. Each of the supply roller 33 and the developing roller 34 moves in an opposite direction at the contact portion of the supply roller 33 and the developing roller 34.

The layer thickness restricting blade 35 is a rectangular plate member that extends along an axial direction of the developing roller 34. The layer thickness restricting blade 35 contacts the developing roller 34 with respect to the rotational direction of the developing roller 34 between a position where the developing roller 34 faces the supply roller 33 and a position where the developing roller 34 faces the photosensitive drum 28.

The layer thickness restricting blade 35 includes a plate spring member 42, a pressing portion 43, a backup member 44 and a support member 45. The pressing portion 43 is provided at a distal end of the plate spring member 42 and contacts the developing roller 34. The backup member 44 is arranged at a rear side of the plate spring member 42. The support member 45 supports a rear end portion of the plate spring member 42 to the developing cartridge 29.

The plate spring member 42 is supported by the developing cartridge 29 by the support member 45, and the pressing portion 43 of the layer thickness restricting blade 35 contacts and is pressed to a surface of the developing roller 34. The pressing portion 43 is formed of insulating silicone rubber.

The photosensitive drum 28 is supported by the drum frame 27 so as to be rotatable in a direction of an arrow (a counterclockwise direction). The photosensitive drum 28 is earthed and a surface of the photosensitive drum 28 is formed of a positive charged photosensitive layer such as polycarbonate. When the developing cartridge 29 is mounted in the drum frame 27, the photosensitive drum 28 is arranged at a side of the developing roller 34 so as to face the developing roller 34.

The scorotron type charger 30 is arranged above the photosensitive drum 28 and apart from the photosensitive drum 28 by a predetermined space therebetween so as not to contact the photosensitive drum 28. The scorotron type charger 30 generates corona discharge from a discharge wire made of tungsten. The scorotron type charger 30 positively charges the surface of the photosensitive drum 28 uniformly.

The transfer roller 31 is supported by the drum frame 27 so as to be rotatable in a direction of an arrow (a clockwise direction) and faces the photosensitive drum 28 below the photosensitive drum 28. The transfer roller 31 is formed by covering a metal roller shaft with a roller portion of a conductive rubber material. A transfer bias is applied to the transfer roller 31 for generating a predetermined potential difference between the transfer roller 31 and the photosensitive drum 28.

The cleaning unit 53 is arranged at an opposite side of the developing roller 34 with respect to the photosensitive drum 28 in the drum frame 27. The cleaning unit 53 comprises a primary cleaning roller 54, a secondary cleaning roller 55, a paper powder storing portion 56 and a scraper 57.

The primary cleaning roller 54 is arranged so as to contact the photosensitive drum 28 at a lower stream side of a position where the photosensitive drum 28 faces the transfer roller 31 and at an upper stream side of a position where the photosensitive drum 28 faces the scorotron type charger 30 with respect to the rotational direction of the photosensitive drum 28.

The primary cleaning roller 54 includes a metal roller shaft 54*a* and a roller portion 54*b* of a conductive foaming material. Foaming silicone rubber, foaming urethane rubber or foaming EPDM may be used for the roller portion 54*b*.

The primary cleaning roller 54 is connected to the photosensitive drum 28 via gears (not shown) and the primary cleaning roller 54 is supported by the drum frame 27 so as to be rotatable in a direction of an arrow (a clockwise direction) according to the rotation of the photosensitive drum.

The secondary cleaning roller 55 is arranged so as to contact the primary cleaning roller 54 at an opposite side of the photosensitive drum 28 with respect to the primary roller 54. The secondary roller 55 is comprised of a metal roller shaft 55*a* and a metal roller portion 55*b* that is formed by metal plating on-an outer surface of the shaft 55*a*.

The secondary cleaning roller 55 is connected to the primary cleaning roller 54 via gears (not shown) and supported by the drum frame 27 so as to be rotatable in a direction of an arrow (a counterclockwise direction) according to the rotation of the primary cleaning roller 54.

The paper powder storing portion 56 is a space formed by the drum frame 27 at a position opposite to the primary cleaning roller 54 with respect to the secondary cleaning roller 55.

The scraper 57 is supported by the drum frame 27 so as to contact the secondary roller 55 at an upper side of the secondary cleaning roller 55. The scraper 57 is formed of a foaming material such as urethane and wipes paper powder adhered to the secondary cleaning roller 55.

The fixing portion 23 is arranged at a side of the process unit 22 and a lower stream side of the paper 3 transporting direction. The fixing portion 23 includes a heat roller 47, a press roller 48 and a transporting roller 49. The heat roller 47 includes a halogen lamp as a heat generating source in a metal cylindrical roller. The press roller 48 is arranged below the heat roller 47 and presses the heat roller 47 from the lower side. The transporting roller 49 is arranged at a lower stream side of the paper 3 transporting direction with respect to the heat roller 47 and the press roller 48.

After a surface of the photosensitive drum 28 is positively charged uniformly by the scorotron type charger 30, the surface of the photosensitive drum 28 is exposed by a laser beam that is emitted from the scanner 21 based on the image data and an electrostatic latent image is formed.

The toner in the toner hopper 32 is moved upwardly by the rotation of the agitator 36 and transported to the supply roller 33. When the agitator 36 is rotated, the cleaner 41 cleans the window 40.

The toner that is transported to the supply roller 33 is supplied to the developing roller 34 according to the rotation of the supply roller 33. When the toner is supplied from the supply roller 33 to the developing roller 34, the toner is rubbed between the supply roller 33 and the developing roller 34, and the toner is positively charged by the frictional force.

The charged toner is bore on the surface of the developing roller 34 and enters between the developing roller 34 and the pressing portion 43 according to the rotation of the developing roller 34. Accordingly, the charged toner is bore on the surface of the developing roller 34 as a thin layer.

The positively charged toner that is bore on the surface of the developing roller 34 faces and contacts the photosensitive drum 28 according to the rotation of the developing roller 34. At this time, the toner is supplied to the electrostatic latent image that is formed on the surface of the photosensitive drum 28 and selectively bores on the photosensitive drum 28 to form a visible image.

According to the rotation of the photosensitive drum 28, the visible image bore on the surface of the photosensitive drum 28 contacts a paper 3 that passes through between the photosensitive drum 28 and the transfer roller 31. Since the transfer bias is applied to the transfer roller 31, the toner on the photosensitive drum 28 moves to the transfer roller 31 and transferred onto the paper 3. The paper 3 where the toner is transferred is transported to the fixing portion 23 via the transporting belt 46, as shown in FIG. 1.

When the paper 3 that is transported to the fixing portion 23 passes through between the heat roller 47 and the press roller 48, the toner is melted by heat that is generated from the halogen lamp and the melted toner is fixed onto the paper 3 by being pressed by the press roller 48.

The paper 3 where the toner is fixed is transported by the transporting roller 49 to the transporting roller 50 and the discharge roller 51 that are arranged in the casing 2.

The transporting roller 50 is arranged at a lower stream side of the paper 3 transporting direction with respect to the transporting roller 49 and the discharge roller 51 is arranged above the discharge tray 52. The paper 3 transported by the transporting roller 49 is transported to the discharge roller 51 by the transporting roller 50 and then discharged onto the discharge tray 52 by the discharge roller 51.

Remaining toner that remains on the surface of the photosensitive drum 28 after transferred to the paper 3 by the transfer roller 31 is collected by the developing roller 34. A system for collecting toner by the developing roller 34 is called a cleanerless developing method.

When the remaining toner is collected by the cleanerless developing method, a special member such as a blade for removing the remaining toner and a storing portion for storing the removed toner are unnecessary. Accordingly, the structure of the printer is simplified.

The cleaning portion 53 temporally captures the remaining toner that remains on the surface of the photosensitive drum 28 after transferring and cleans the paper powder that is adhered to the surface of the photosensitive drum 28 from the paper 3 during the transferring operation.

When the toner is transferred to the paper 3, negative bias that is lower than the surface potential of the photosensitive drum 28 is applied to the primary cleaning roller 54 for attracting the toner on the photosensitive drum 28 to the primary cleaning roller 54. Then, the remaining toner on the photosensitive drum 28 is temporally captured by the primary cleaning roller 54.

On the other hand, when the toner is not transferred to the paper 3, that is, at a timing after the transferring operation for a paper 3 and before the transferring operation for a next paper 3, the toner that is captured by the primary cleaning roller 54 is returned to the photosensitive drum 28 and positive bias that is higher than the surface potential of the photosensitive drum 28 is applied to the primary cleaning roller 54 for attracting the paper powder that is adhered to the photosensitive drum 28.

Then, the toner that is temporally captured by the primary cleaning roller 54 is returned to the photosensitive drum 28, while the paper powder that is adhered to the photosensitive drum 28 from the paper 3 during the transferring operation is captured by the primary cleaning roller 54. The toner that is returned to the photosensitive drum 28 is collected by the developing roller 34.

Therefore, even if a large amount of toner remains on the surface of the photosensitive drum 28 after the transferring operation, the toner is temporally captured by the primary cleaning roller 54 and returned to the photosensitive drum 28 and the toner is surely collected by the developing roller 34.

On the other hand, positive bias that is higher than the surface potential of the primary cleaning roller 54 is applied to the secondary cleaning roller 55 to attract only the paper powder adhered on the primary cleaning roller 54. The paper powder that is captured by the primary cleaning roller 54 is electrically captured by the secondary cleaning roller 55 when facing the secondary cleaning roller 55. The paper powder that is captured by the secondary cleaning roller 55 is wiped by the scraper 57 and stored in the paper powder storing portion 56 when facing the scraper 57.

Accordingly, the toner is collected by the developing roller 34 and the paper powder is stored in the paper powder storing portion 56.

The laser printer 1 includes a retransporting unit 61 for forming images on both sides of a paper 3. The retransporting unit 61 includes a reverse mechanism 62 and a retransporting tray 63 that are integrally formed with each other. The reverse mechanism 62 is mounted from a rear side of the casing 2 and the retransporting tray 63 is inserted above the feeder portion 4. The reverse mechanism 62 and the retransporting tray 63 are detachable from the casing 2.

The reverse mechanism 62 includes a casing 64, a reverse roller 66, a retransporting roller 67 and a reverse guide plate 68. A cross sectional shape of the casing 64 is approximately rectangular. The reverse roller 66 and the retransporting roller 67 are arranged in the casing 64. The reverse guide plate 68 extends upwardly from an upper end portion of the casing 64.

A flapper 65 is arranged at a lower stream side of the transporting roller 49 for selectively switching a paper 3 transporting direction between a direction forwarding to the transporting roller 50 (a solid line shown in FIG. 1) and a direction forwarding to the reverse roller 66 (a dotted line shown in FIG. 1).

The flapper 65 is supported at the rear portion of the casing 2 so as to swing and arranged in the vicinity of lower stream side of the transporting roller 49. The flapper 65 swings according to excitation or non-excitation of a solenoid (not shown).

The reverse roller 66 includes a pair of rollers that are arranged at a lower stream side of the flapper 65 and at an upper side of the casing 64. The rotational direction of the rollers is switched between a normal direction and a reverse direction. When the reverse rollers 66 are rotated in a normal direction, a paper 3 is transported to the reverse guide plate 68. When the reverse rollers 66 are rotated in a reverse direction, the paper 3 is transported to the retransporting roller 67.

The retransporting roller 67 comprises a pair of rollers that are arranged at a lower stream side of the reverse roller 66 and almost right below the reverse roller 66. The retransporting rollers 67 transport the paper 3 that is transported from the reverse rollers 66 to the retransporting tray 63.

The reverse guide plate 68 is a plate member that extends from an upper end portion of the casing 64 upwardly and guides the paper 3 that is transported by the reverse rollers 66.

When images are formed on both sides of a paper 3, the flapper 65 is switched to a direction that forwards the paper 3 to the reverse rollers 66 and the reverse mechanism 62 receives a paper 3 where an image is formed on one side.

When the received paper 3 is transported to the reverse rollers 66, the reverse rollers 66 hold the paper 3 and rotate in the normal direction for transporting the paper 3 upwardly along the reverse guide plate 68. When most parts of the paper 3 is transported upwardly and the rear end of the paper 3 is held by the reverse rollers 66, the transporting rollers 66 stop rotating in the normal direction.

Next, the reverse rollers 66 rotate in the reverse direction for transporting the paper 3 in a reverse direction with respect to the front and rear end of the paper 3. A paper passing sensor 76 is arranged at a lower stream side of the fixing portion 23. After a predetermined time has passed after the paper passing sensor 76 detects a rear end of the paper 3, the rotational direction of the reverse rollers 66 is switched from the normal direction to the reverse direction.

When the paper 3 transportation to the reverse rollers 66 is finished, the flapper 65 is switched to a condition for transporting a paper 3 that is transported from the transporting roller 49 to the transporting roller 50. The paper 3 that is transported to the retransporting rollers 67 is transported to retransporting tray 63. The retransporting tray 63 includes a paper supply portion 69 where a paper 3 is supplied, a tray body 70 and a diagonally feeding rollers 71.

The paper supply portion 69 is arranged at a lower side of the reverse mechanism 62 in the rear of the casing 2 and includes a curved paper guide member 72. The paper 3 transported almost vertically from the retransporting rollers 67 is guided almost horizontally by the paper guide member 72 and transported to the tray body 70.

The tray body 70 is almost rectangular and arranged horizontally above the supply tray 6. An upper stream side end portion of the tray body 70 is connected to the paper guide member 72 and a lower stream side end portion is connected to an upper stream side end portion of the retransporting path 73.

On the transporting path of the tray body 70, two diagonally feeding rollers 71 are arranged with a predetermined distance therebetween along the paper 3 transporting direction so as to transport the paper 3 with contacting a reference plate (not shown).

The diagonally feeding rollers 71 are arranged in the vicinity of the reference plate (not shown) that is arranged on one end of the tray body 70 in its width direction. The diagonally feeding rollers 71 include a diagonally feeding drive roller 74 and a diagonally feeding following roller 75.

The diagonally feeding drive roller 74 is arranged so that its axial direction is perpendicular to the paper 3 transporting direction. The diagonally feeding following roller 75 faces a paper 3 while holding the paper 3 therebetween. The diagonally feeding following roller 75 is arranged with its axial direction diagonal to the paper 3 transporting direction so that a paper 3 is transported to the reference plate.

The paper 3 that is transported from the paper supply portion 69 to the tray body 70 is transported to the transporting roller 9 via the retransferring path 73. During the transportation to the transporting roller 9, one end of the paper 3 in its width direction is contacted to the reference plate by the diagonally feeding rollers 71.

The transferring roller 9 transports the paper to the image forming position again. The paper 3 that is transported to the image forming position contacts the photosensitive drum 28 with its side that is opposite to the side where the image has already formed. An image is formed on the opposite side of the paper 3. After images are formed on two sides of the paper 3, the paper 3 is discharged to the discharge tray 52.

The developing cartridge 29 will be explained more in details with reference to FIGS. 3-9.

Figure 3:
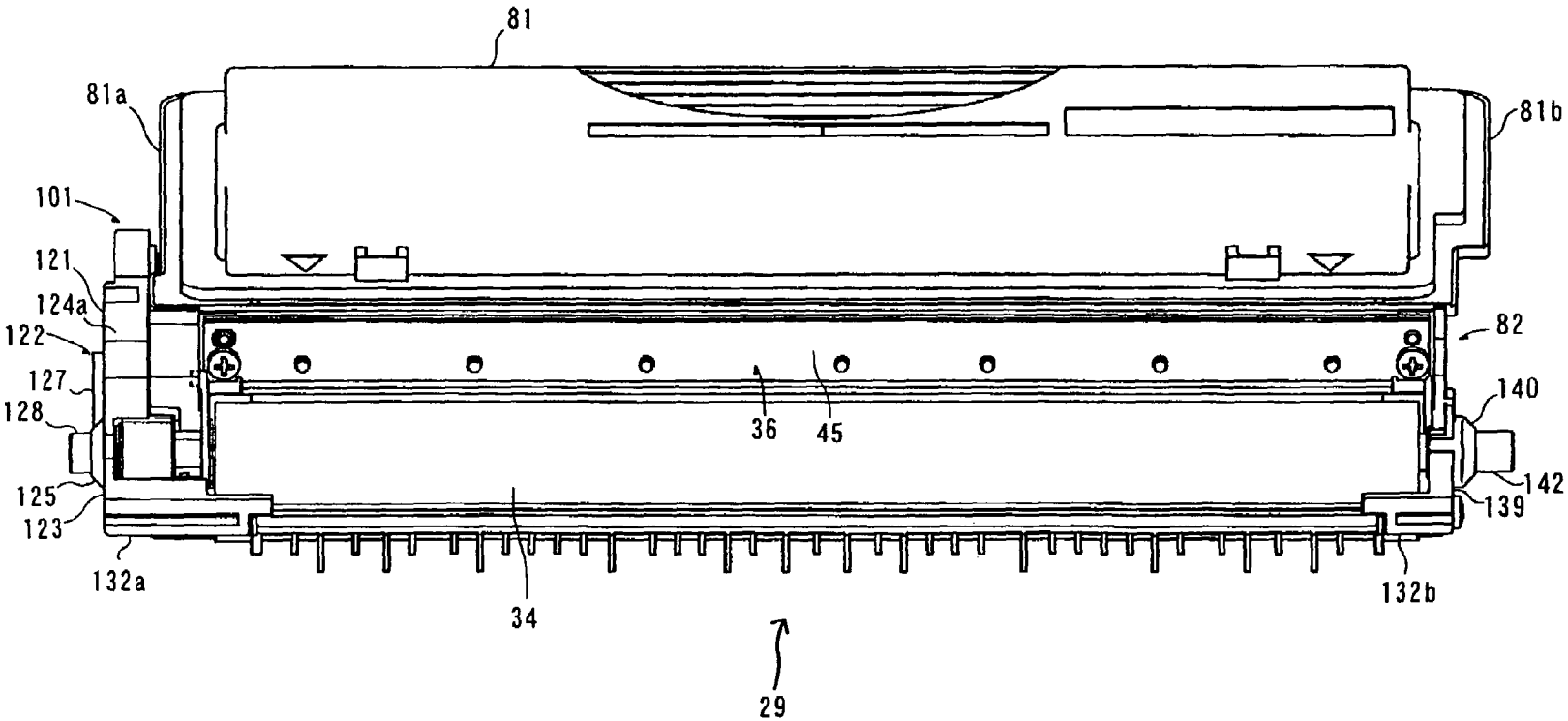
FIG. 3 is a front view of a developing cartridge.
Figure 4:
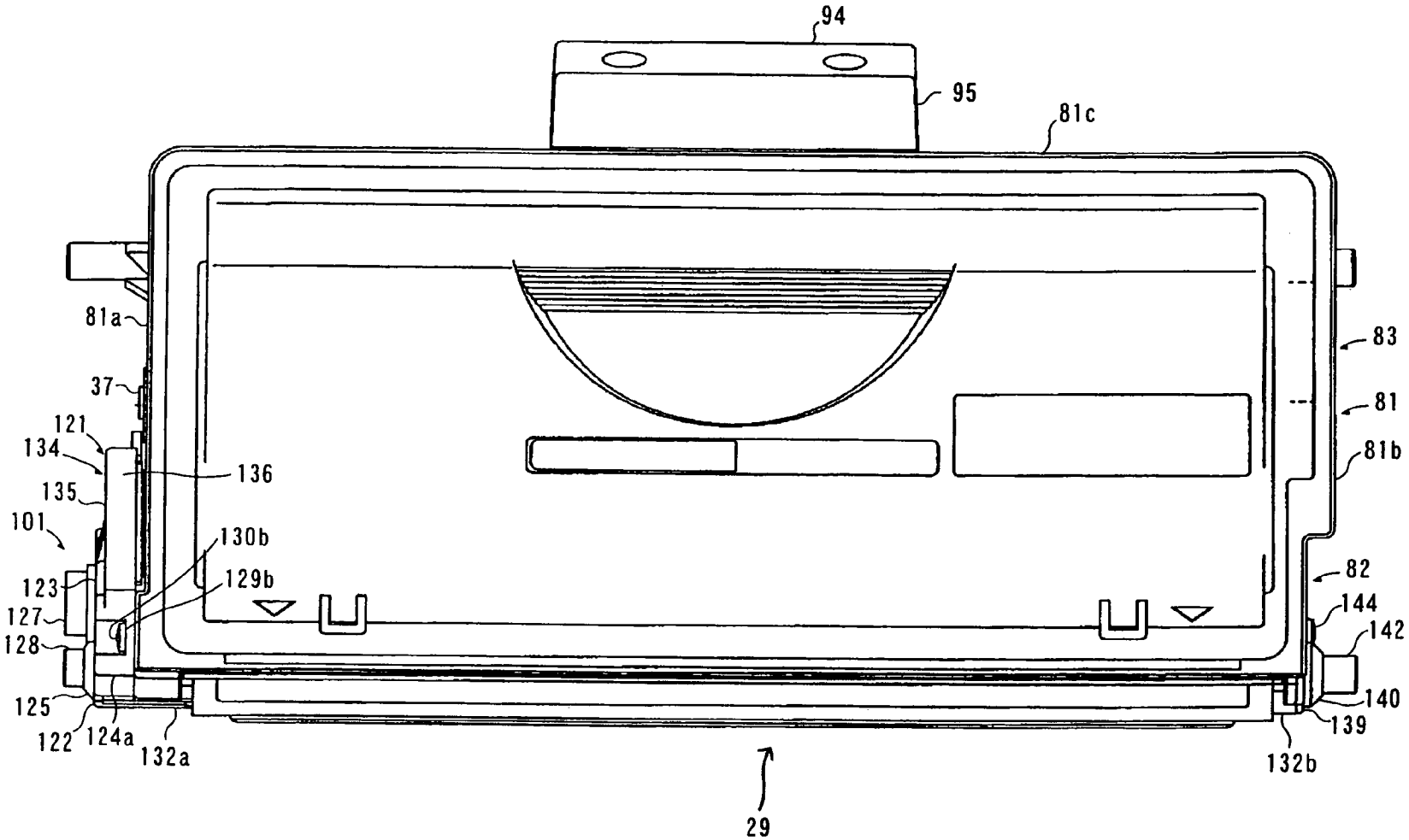
FIG. 4 is a plan view of the developing cartridge.
Figure 5:
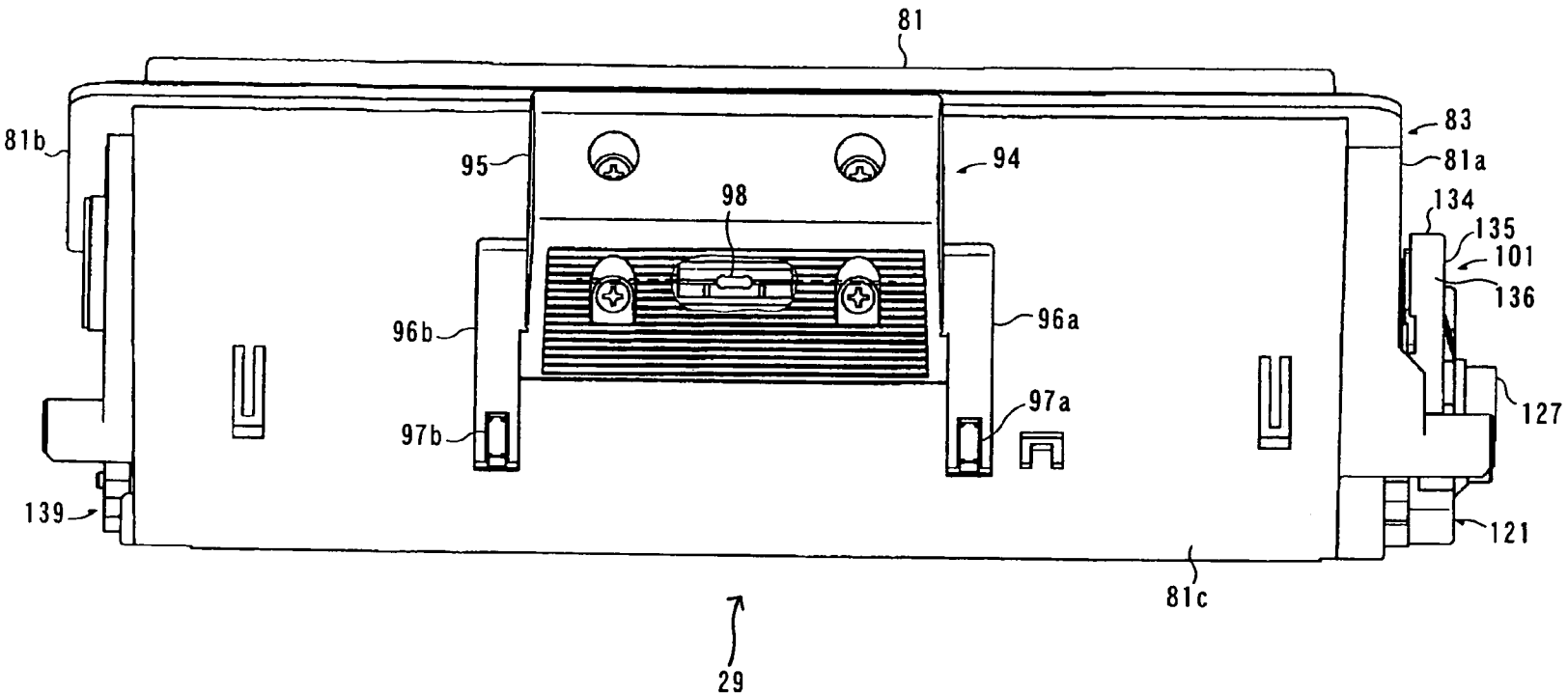
FIG. 5 is a rear view of the developing cartridge.

A front view, a plan view and a rear view of the developing cartridge 29 is almost rectangular as shown in FIGS. 3-5. The developing cartridge 29 includes a housing 81 of a box with its front end side (a lower side in FIG. 4) open.

Figure 6A:
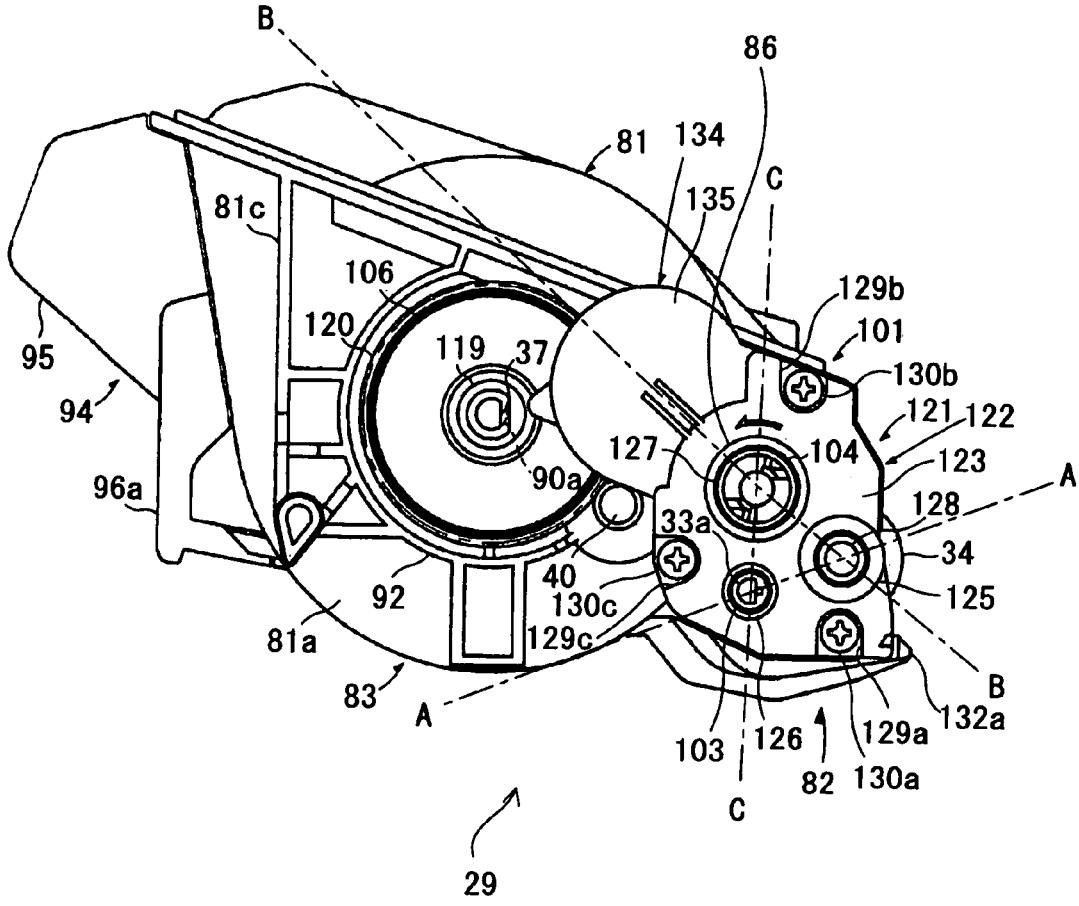
FIG. 6A is a left side view of the developing cartridge and FIG. 6B is a right side view of the developing cartridge.
Figure 6B:
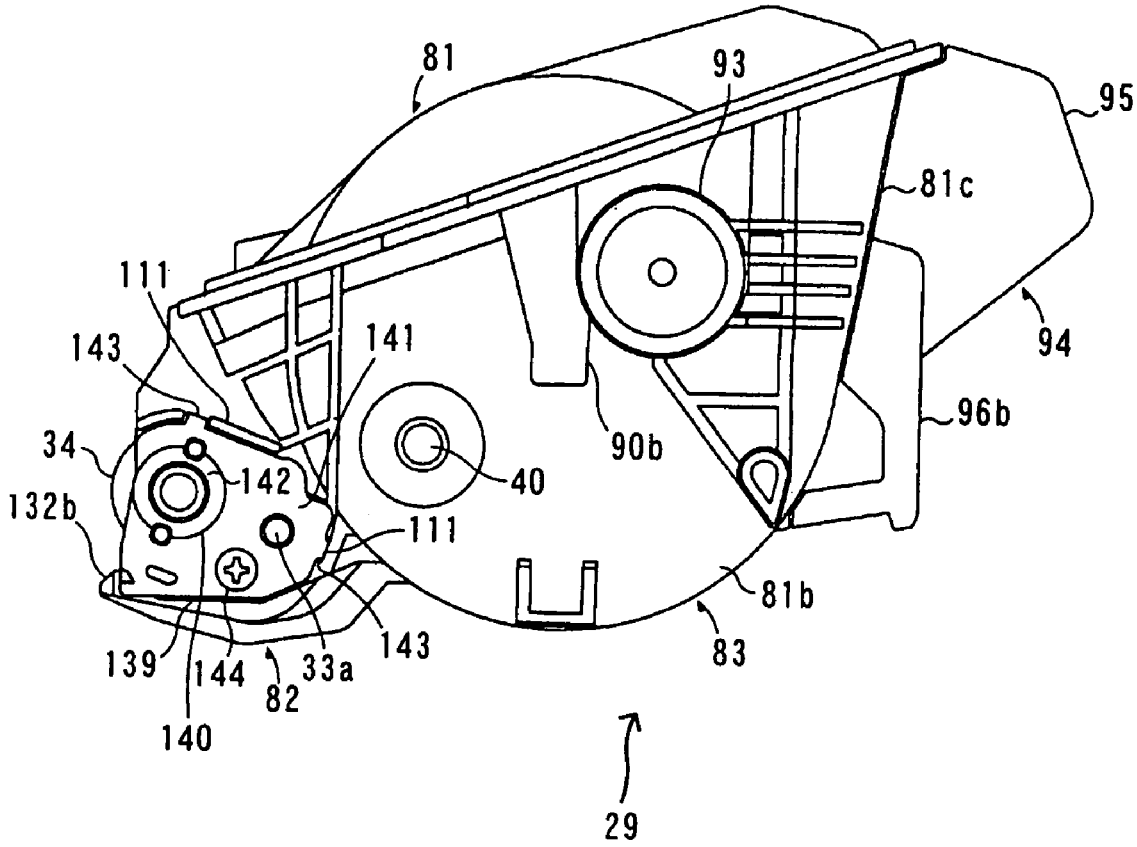

The housing 81 is made of resin and includes a front side portion 82 and a rear side portion 83 that are integrally formed with each other. The front side portion 82 includes the supply roller 33, the developing roller 34 and the layer thickness restricting blade 35. The rear side portion 83 includes the toner hopper 32 and the agitator 36. Side walls 81*a*, 81*b* are arranged at two ends of the housing 81 in its longitudinal direction, as shown in FIGS. 6A and 6B.

Figure 8A:
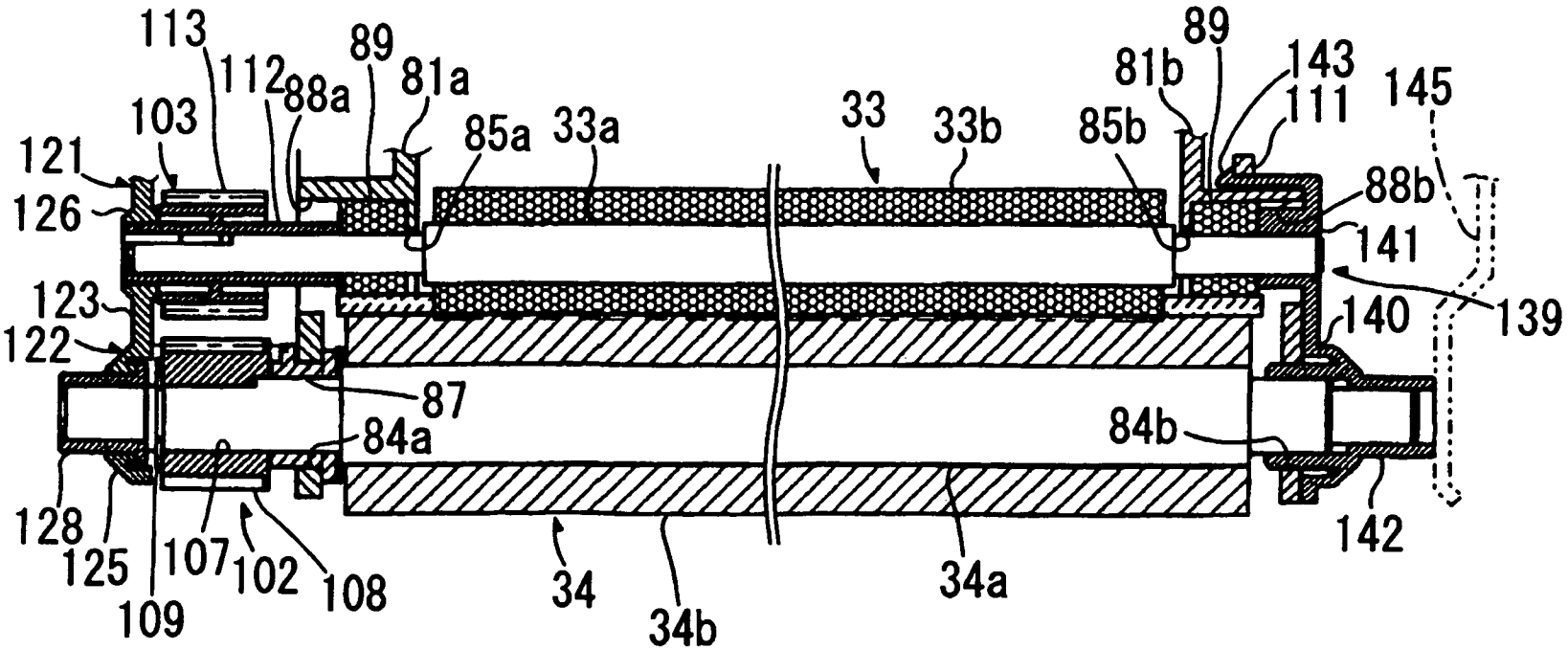
FIG. 8A is a cross sectional view taken along A-A line in FIG. 6B.
Figure 8B:
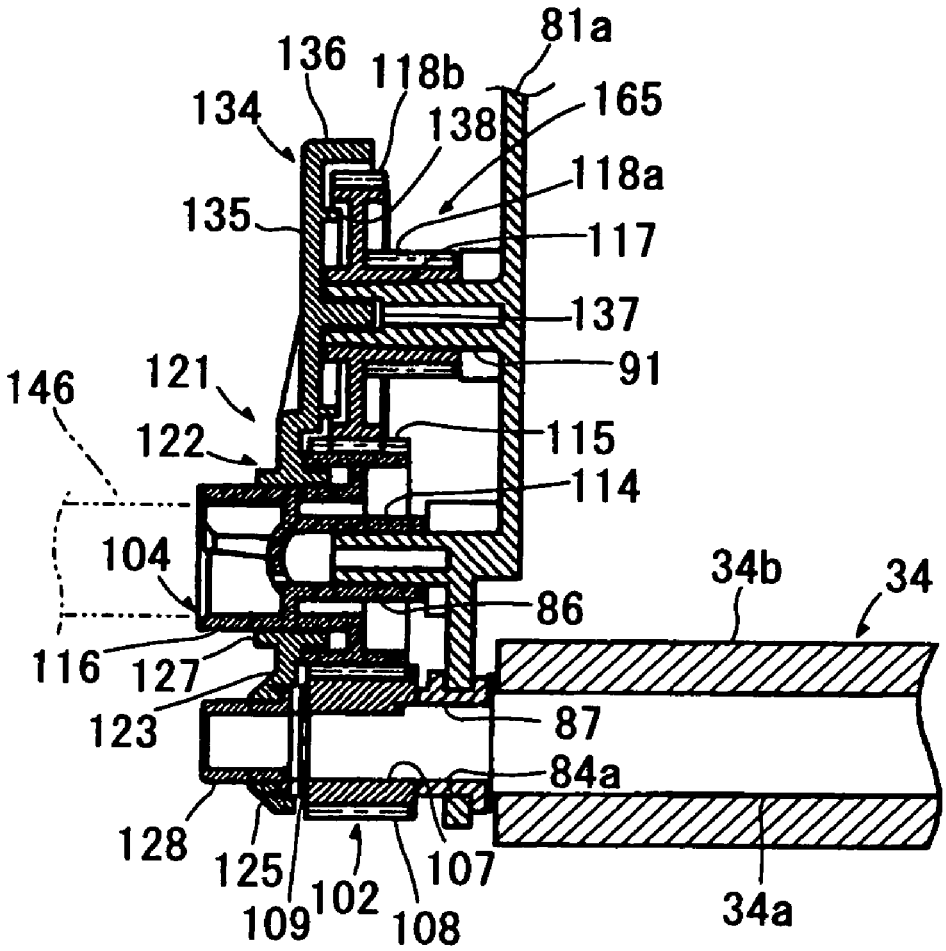
FIG. 8B is a cross sectional view taken along B-B line in FIG. 6B.
Figure 8C:
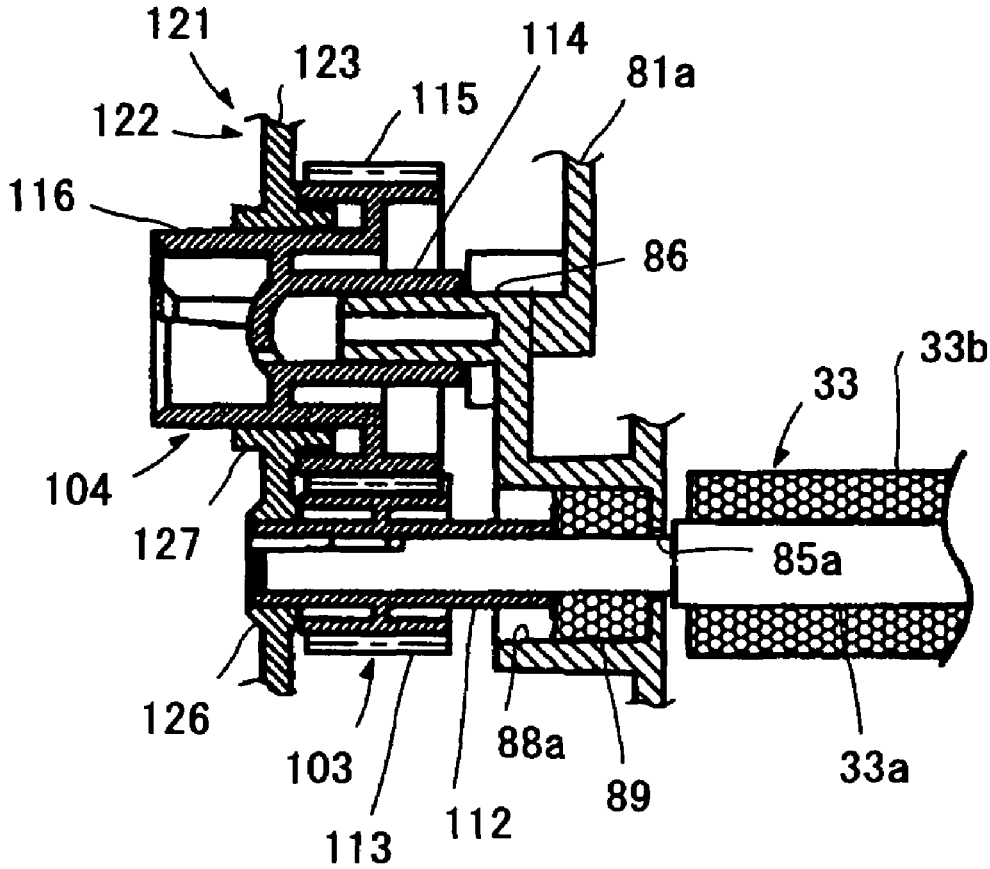
FIG. 8C is a cross sectional view taken along C-C line in FIG. 6B.

Two developing roller receiving members 84*a*, 84*b* and two supply roller insertion portions 85*a*, 85*b* and an input gear boss portion 86 are arranged at the front side portion 82 of the housing 81*a* as shown in FIGS. 8A, 8B, 8C.

As shown in FIGS. 8A and 8B, the developing roller receiving member 84*a* is arranged on the side wall 81*a* and the developing roller receiving member 84*b* is arranged on the side wall 81*b* so as to face the developing roller receiving member 84*a*.

One end of the roller shaft 34*a* of the developing roller 34 is supported rotatably by the developing roller receiving member 84*a* via a shaft receiving member 87 that is fitted to the developing roller receiving member 84*a* so as to be extended outside of the housing 81. The other end of the roller shaft 34*a* is supported rotatably by the developing roller receiving member 84*b* via a developing roller shaft receiving member 140 of a shaft receiving member 139 so as to be extended outside of the housing 81.

When the developing roller 34 is supported by the developing roller receiving members 84*a* and 84*b*, the roller shaft is exposed outside from the front end portion of the housing 81 as shown in FIG. 3. An end portion that is extended outside from the side wall 81*a* of the roller shaft 34*a* is formed so that a part of its peripheral surface is cut away (not shown).

As shown in FIGS. 8A and 8C, a recess portion 88*a*, 88*b* is formed in the side wall 81*a*, 81*b* of the housing 81 at a lower diagonal rear side of the developing roller receiving member 84*a*, 84*b*, respectively. The recess portion 88*a*, 88*b* is recessed to an inner side in the axial direction of the developing roller 34. The recess portions 88*a* and 88*b* are arranged so as to face each other and a supply roller insertion portion 85*a*, 85*b* is arranged in the recess portion 88*a*, 88*b* respectively.

One end of the roller shaft 33*a* of the supply roller 33 is supported rotatably by the supply roller insertion portion 85*a* so as to be extended outside of the housing 81. The other end of the roller shaft 33*a* is supported rotatably by the supply roller insertion portion 85*b* so as to be extended outside of the housing 81.

A sponge seal 89 is arranged in the recess portion 88*a*, 88*b* and the roller shaft 33*a* is inserted to the sponge seal 89. Therefore, toner leakage from the supply roller insertion portion 85*a*, 85*b* is prevented.

As shown in FIG. 8A, the surface of the supply roller 33 is arranged so as to contact the surface of the developing roller 34 over its longitudinal direction. As shown in FIG. 6, the shaft end portion that is extended outside from the side wall 81*a* of the roller shaft 33*a* of the supply roller 33 is formed so that its outer peripheral surface is partially cut away.

As shown in FIGS. 8B, 8C, the input gear boss portion 86 is formed with extended from the side wall 81 to outside at a lower diagonal rear side of the developing roller receiving member 84*a* that is formed in the side wall 81*a* and at an upper side of the supply roller insertion portion 85*a*.

Figure 7:
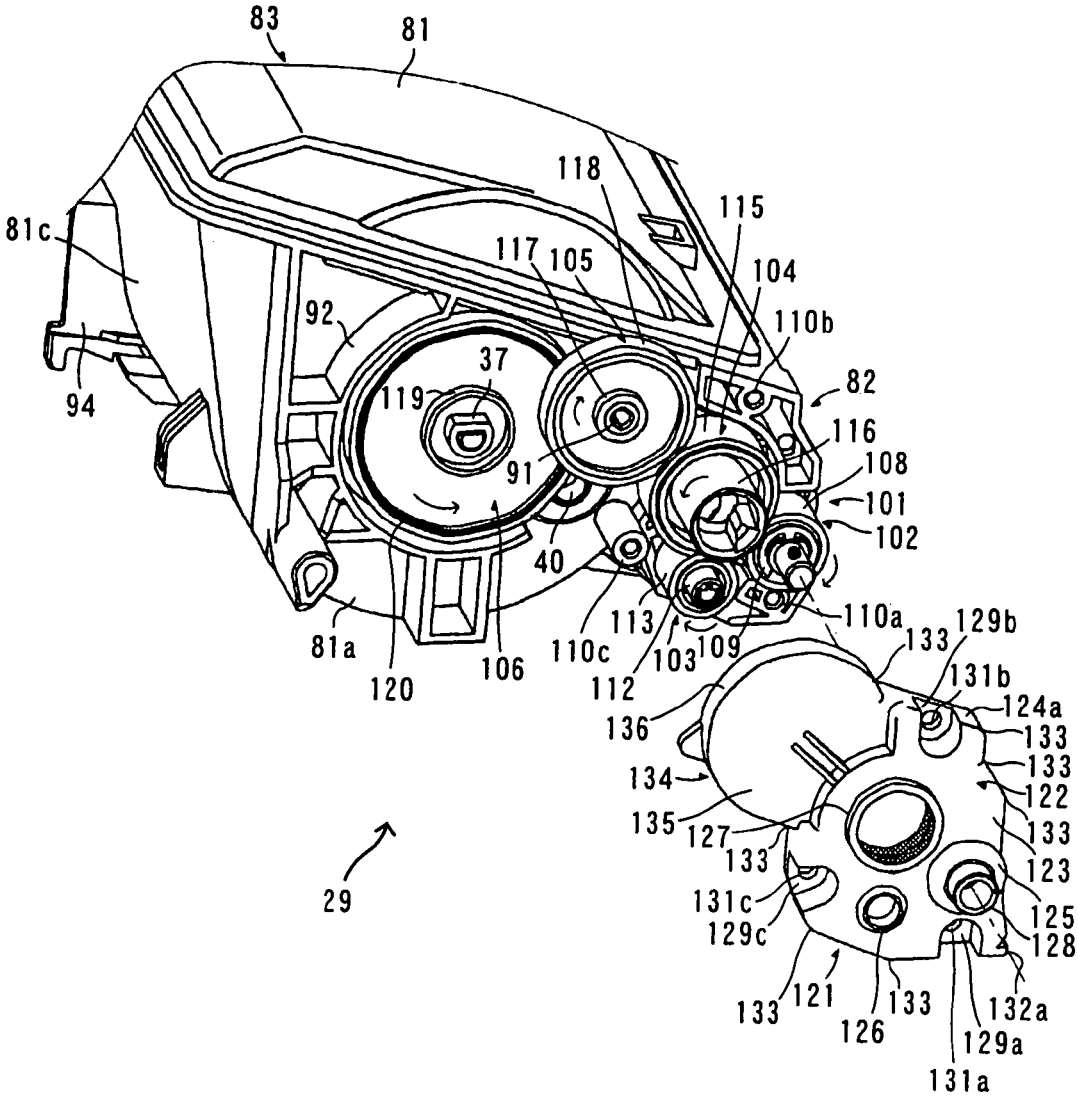
FIG. 7 is an assembling view of a gear holder.

As shown in FIG. 7, a screw portion 110*a*, 110*b* and 110*c* are arranged in the side wall 81*a* corresponding to a mounting portion 129*a*, 129*b* and 129*c*, respectively. The screw portion 110*a* is formed at a lower end portion of the developing roller receiving member 84*a*, and the screw portion 110*b* is formed at an upper end portion of the input gear boss portion 86 and the screw portion 110*c* is formed at a side end portion between the supply roller insertion portion 85*a* and the input gear boss portion 86.

As shown in FIG. 6B, two cutaway portions 111 are formed in the side wall 81*b* corresponding to two stop portions 143. The cutaway portions 111 receive the stop portions 143.

As shown in FIGS. 6A and 6B, the side view of the rear side portion 83 of the housing 81 is almost an arc and an inner space surrounded by the rear side portion 83 forms the toner hopper 32. The rear side portion 83 includes a rotational shaft support member 90*a*, 90*b* and an idle gear boss 91 shown in FIG. 7.

As shown in FIG. 6A, a rotational shaft support member 90*a* is arranged in the side wall 81*a* of the housing 81. The rotational shaft support member 90*a* is fitted to one side of the rotational shaft 37 of the agitator 36. As shown in FIG. 6B, a rotational shaft support member 90*b* is arranged in the side wall 81*b* of the housing 81. The rotational shaft support member 90*b* has a U-shaped cross section and receives one side of the rotational shaft 37 of the agitator 36. As shown in FIG. 6A, the shaft end portion that is extended outside from the side wall 81*a* of the rotational shaft 37 is formed in a shape of a half moon, that is, its outer peripheral surface is partially cut away.

The rotational shaft 37 of the agitator 36 is rotatably supported by the rotational shaft support member 90*a*, so that one end of the rotational shaft 37 is inserted into the rotational shaft support member 90*a*. The other end of the rotational shaft 37 is maintained inside of the housing 81 and supported rotatably by the rotational shaft support member 90*b*.

As shown in FIGS. 6A, 7 and 8B, the idle gear boss 91 is cylindrical and extended outside from the side wall 81*a* between the input gear boss 86 in the side wall 81*a* of the housing 81 and the rotational shaft support member 90*a*.

As shown in FIGS. 6A and 6B, windows 40 are formed in the wall 81*a*, 81*b* respectively for detecting the remaining amount of toner.

As shown in FIG. 6A, an arc-shaped agitator drive gear cover 92 that covers an agitator drive gear 106 is arranged in the side wall 81*a*.

As shown in FIG. 6B, a toner cap 93 is mounted on the side wall so as to be opened and closed.

As shown in FIG. 5, a handle member 94 is arranged at a rear end of the housing 81. The handle member 94 is formed so as to be extended from the rear wall 81*c* of the housing 81 to the rear side. The handle member 94 is formed integrally with a handle body 95 and leg members 96*a* and 96*b*. A rear view of the handle member 94 is rectangular and the leg members 96*a* and 96*b* are arranged on two sides of the handle body 95.

A fuse 98 is arranged in the handle body 95. An electrode 97*a*, 97*b* is arranged at a lower end of the leg member 96*a*, 96*b* respectively. A surface of the electrode 97*a*, 97*b* is exposed in an almost rectangular shape at a lower end portion of the leg member 96*a*, 96*b*. The electrodes 97*a* and 97*b* are connected to each other via the fuse 98.

After the developing cartridge 29 is mounted in the drum frame 27, the process unit 22 is mounted in the casing 2 of the laser printer 1. During the printing operation, the developing cartridge 29 is moved to a contact position by a contact/apart mechanism (not shown) and the developing roller 34 and the photosensitive drum 28 are contacted with each other as shown in FIG. 2.

When the printing operation is not carried out, the developing cartridge 29 is moved to a separation position in an opposite direction and the developing roller 34 and the photosensitive drum 28 are separated from each other.

When the developing cartridge 29 is in the separation position, the electrodes 97*a*, 97*b* contact body side electrodes (not shown) that are arranged on the casing 2. When the developing cartridge 29 is in the contact position, the electrodes 97*a*, 97*b* are separated from the body side electrodes.

When the developing cartridge 29 is in the separation position, that is, when the printing operation is not carried out, the electrodes 97*a*, 97*b* are contacted to the body side electrodes to detect whether the fuse 98 is connected or disconnected.

As shown in FIG. 7, a gear mechanism 101 is arranged on the side wall 81*a* for rotating the rotational shaft 37 of the developing roller 34, the supply roller and the agitator 36.

The gear mechanism 101 includes a developing roller drive gear 102, a supply roller drive gear 103, an input gear 104, an idle gear 105 and an agitator drive gear 106.

As shown in FIGS. 7, 8A, 8B, the developing roller drive gear 102 is cylindrical and a shaft hole 107 of a different shape is formed at a center of the developing drive gear 102. A helical gear tooth 108 is formed at the outer periphery of the developing roller drive gear 102.

The roller shaft 34*a* of the developing roller 34 that is extended from the developing roller receiving member 84*a* is inserted into the shaft hole 107 of the developing roller drive gear 102. This restricts relative rotation of the developing roller drive gear 102 with respect to the roller shaft 34*a*.

A ring member 109 is fitted onto the roller shaft 34*a* from the outside in its axial direction. This restricts an axial movement of the developing roller drive gear 102 with respect to the roller shaft 34*a*.

Thus, the developing roller drive gear 102 is not movable relative to the roller shaft 34*a*. That is, only when the developing roller drive gear 102 is rotated, the developing roller 34 is rotated.

When the developing roller drive gear 102 is assembled to the roller shaft 34*a*, the shaft end portion of the roller shaft 34*a* of the developing roller 34 is extended outside from the developing roller drive gear 102.

As shown in FIGS. 7, 8A, 8C, the supply roller drive gear 103 includes a cylindrical shaft insertion member 112 and a helical gear tooth 113 that are integrally formed with each other. An inner surface of the cylindrical shaft insertion member 112 is formed in a different shape and the helical gear tooth 113 is formed around the shaft insertion member 112.

The inner surface of the shaft insertion member 112 of the supply roller drive gear 103 is inserted onto the roller shaft 33*a* of the supply roller 33 that is extended from the supply roller insertion portion 85*a*. This restricts relative rotation of the supply roller drive gear 103 with respect to the roller shaft 33*a*.

When the supply roller drive gear 103 is assembled to the roller shaft 33*a*, the shaft end portion of the roller shaft 33*a* of the supply roller 33 is covered by the shaft insertion member 112 of the supply roller drive gear 103 and is not extended outside.

As shown in FIGS. 7, 8B, 8C, the input gear 104 includes a cylindrical shaft 114, a helical gear tooth 115 and a cylindrical input portion 116 that are integrally formed with each other. The helical gear tooth 115 is formed around the shaft 114. A diameter of the input portion 116 is larger than that of the shaft 114 and smaller than that of the helical gear tooth 115 and the input portion 116 is extended outside in its axial direction from the shaft 114 and the helical gear tooth 115.

The shaft 114 of the input gear 104 is fitted onto the input gear boss 86 and the input gear 104 is rotatably supported by the input gear boss portion 86. When the input gear 104 is supported by the input gear boss portion 86, the helical gear tooth 115 is interlocked with the helical gear tooth 108 of the developing roller drive gear 102 and the helical gear tooth 113 of the supply roller drive gear 103 simultaneously.

As shown in FIG. 7, when the developing roller drive gear 102, the supply roller drive gear 103 and the input gear 104 are mounted on the side wall 81, the gears 102, 103, 104 are arranged next to each other in a triangle, that is, the developing roller drive gear 102 is arranged at a front side, and the supply roller drive gear 103 is arranged at a lower rear side with respect to the developing roller drive gear 102, and the input gear 104 is arranged at an upper rear side with respect to the developing roller drive gear 102 and at an upper side with respect to the supply roller drive gear 103.

As shown in FIGS. 7 and 8B, the idle gear 105 includes a cylindrical shaft 117, a first gear tooth 118*a* and a second gear tooth 118 that are integrally formed with each other. The first gear tooth 118*a* is spur tooth that is arranged in an inner side of the shaft 117. The second gear tooth 118*b* is arranged in an outer side of the shaft 117 and includes of helical gear tooth. The diameter of the second gear tooth 118*b* is larger than that of the first gear tooth 118*a*.

The shaft 117 of the idle gear 105 is inserted into an idle gear boss 91 and the idle gear 105 is rotatably supported by the idle gear boss 91. When the idle gear 105 is mounted in the idle gear boss 91, the second gear tooth 118*b* is interlocked with the gear tooth 115 of the input gear 104.

As shown in FIG. 7, the agitator drive gear 106 includes a cylindrical shaft insertion member 119 and a spur gear tooth 120 that are integrally formed with each other. An inner peripheral surface of the shaft insertion member 119 is formed differently and the spur gear tooth 120 is formed around the shaft insertion member 119.

The agitator drive gear 106 is arranged inside of the agitator drive gear cover 92. An inner peripheral surface of the shaft insertion member 119 is fitted onto the rotational shaft 37 that is extended from the rotational shaft support member 90*a*. This restricts relative rotation of the agitator drive gear 106 with respect to the rotational shaft 37.

When the agitator drive gear 106 is supported by the rotational shaft 37, the spur gear tooth 120 of the agitator drive gear 106 is interlocked with the first gear tooth 118*a* of the idle gear 105. The axial movement of the agitator drive gear 106 is restricted by the idle gear 105.

In the gear mechanism 101, a gear holder 121 for covering the developing roller drive gear 102, the supply roller drive gear 103, the input gear 104 and the idle gear 105 is mounted outside of the side wall 81*a*.

Figure 9A:
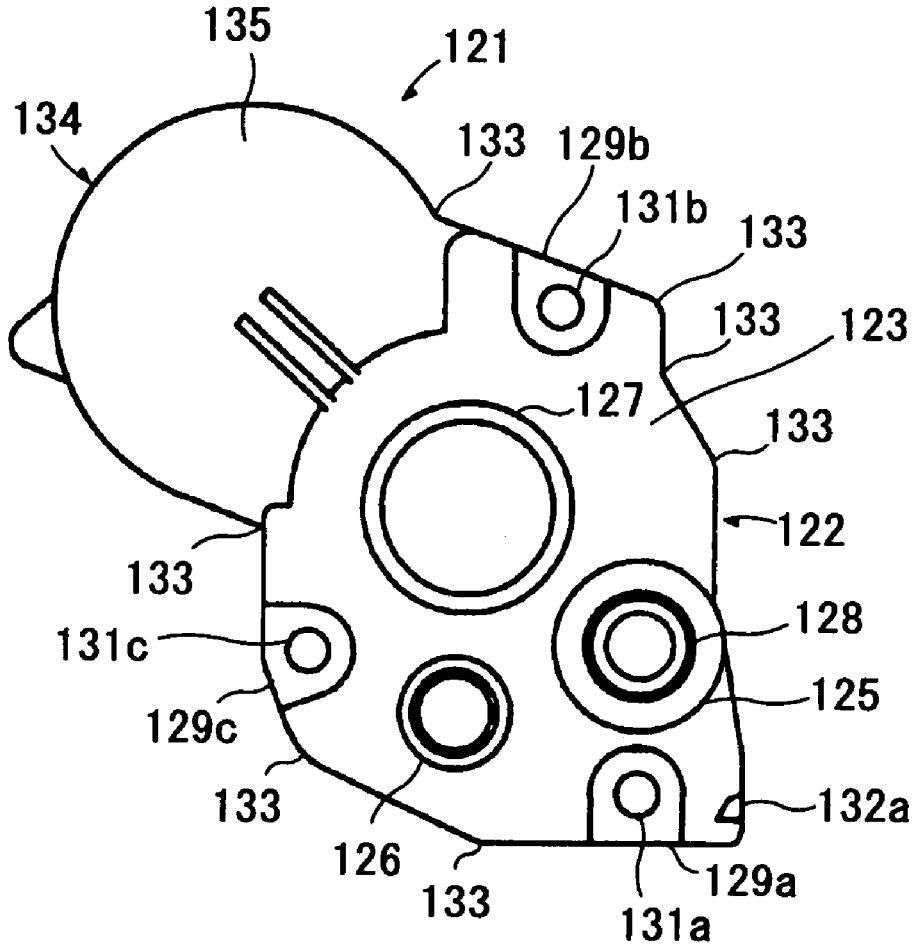
FIG. 9A is a front view of the gear holder and FIG. 9B is a rear view of the gear holder.
Figure 9B:
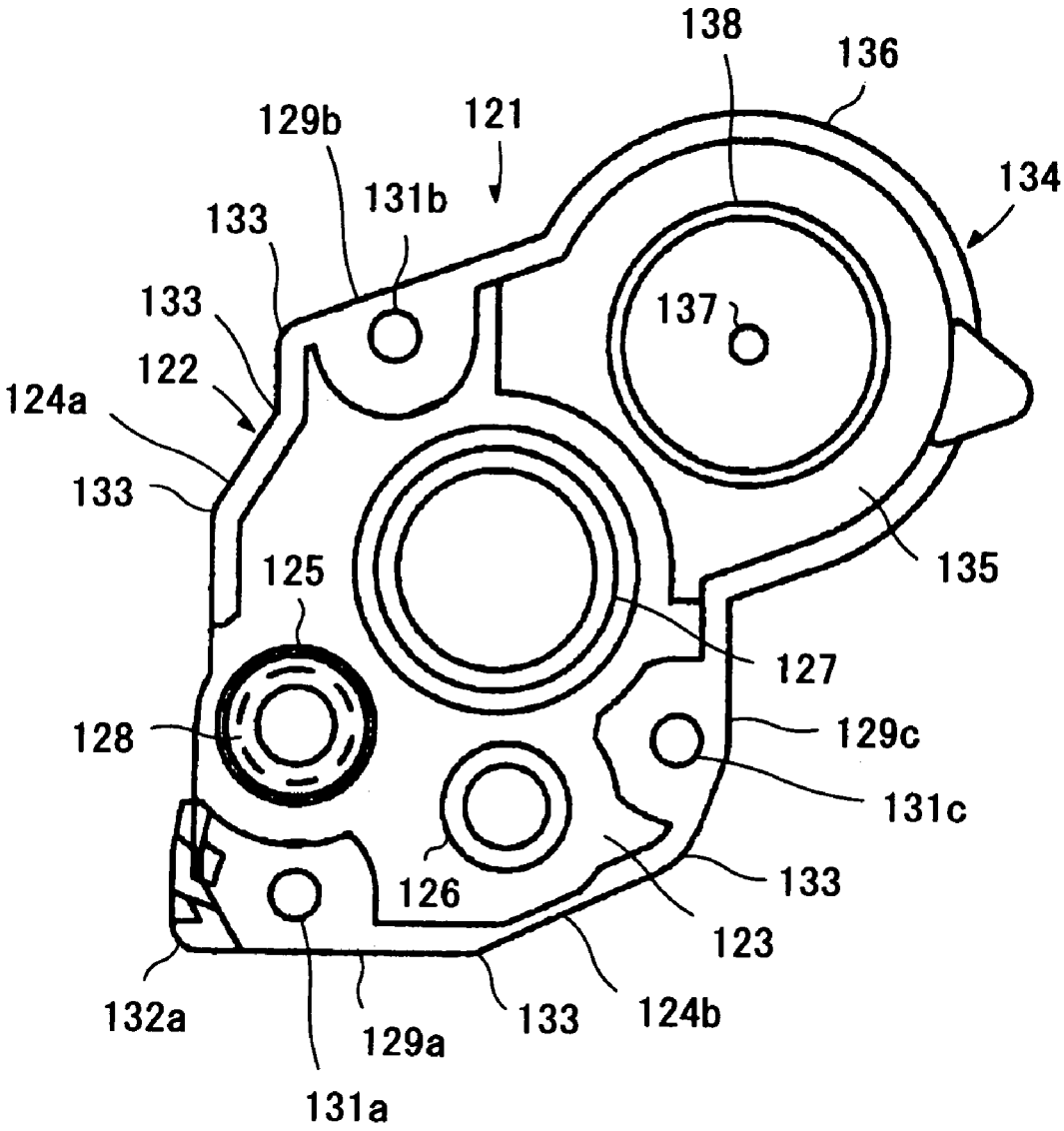

As shown in FIGS. 7, 9A, 9B, the gear holder 121 includes a developing roller drive gear 102, a first cover 122 and a second cover 134 that are integrally formed with each other. The first cover 122 covers the input gear 104 and the second cover 134 covers the idle gear 105.

The first cover 122 includes a first cover portion 123, a first side portion 124*a*, 124*b*, a mounting portion 129*a*, 129*b*, 129*c* and a receiving portion 132*a* that are integrally formed with each other. The first cover portion 123 is arranged with a predetermined distance from the side wall 81*a*. The first side portion 124*a*, 124*b*, 124*c* is extended from a peripheral end of the first cover portion 123 to the side wall 81*a*. The gear holder 121 is mounted on the side wall 81*a* by a screw 130*a*, 130*b*, 130*c* via the mounting portion 129*a*, 129*b*, 129*c*. The receiving portion 132*a* receives toner that is leaked from an end portion of the developing roller 34. In embodiments of the present disclosure, the receiving portion 132*a* corresponds to the developing agent receiving portion.

The first cover portion 123 is made of a flat plate and has almost the same shape as the front side portion 82 of the housing 81 seen from the side. The first cover portion 123 includes a developing roller support member 125, a supply roller support member 126 and an input gear support member 127. The developing roller support member 125 supports the roller shaft 34*a* of the developing roller 34, and the supply roller support member 126 supports the roller shaft 33*a* of the supply roller 33, and the input gear support member 127 supports the input gear 104. In embodiments of the present disclosure, the developing roller support member 125 and the supply roller support member 126 correspond to the first support and the second support, respectively.

The developing roller support member 125 is formed in a circular opening at a front end portion of the first cover portion 123. The developing roller support member 125 determines the position of the gear holder 121 with reference to the developing roller support member 125.

As shown in FIGS. 8A, 8B, a periphery of the opening of the developing roller support member 125 is extended from the first cover 123 toward the outside to taper like a cone.

A cylindrical collar member 128 is detachably fitted to the developing roller support member 125 so as to be extended outside from the developing roller support member 125. The collar member 128 is not rotatable with respect to the developing roller support member 125 and the roller shaft 34*a* slides along the inner surface of the collar member 128.

The supply roller support member 126 is formed in a circular opening at a lower diagonal rear side of the developing roller support member 125 on the first cover portion 123. As shown in FIGS. 8B, 8C, a periphery of the opening is extended a little from a front and a rear surface of the first cover in a ring.

The input gear support member 127 is formed in a circular opening at an upper diagonal rear side of the developing roller support member 125 and at an upper side of the supply roller support member 126 on the first cover portion 123. As shown in FIGS. 8B, 8C, a periphery of the opening is extended cylindrically from the front surface and the rear surface of the first cover portion 123.

A diameter of the input gear support member 127 is larger than that of the developing roller support member 125 and that of the supply roller support member 126, and the input portion 116 of the input gear 104 is inserted thereto.

The developing roller support member 125, the supply roller support member 126 and the input gear support member 127 correspond to the developing roller drive gear 102, the supply roller drive gear 103 and the input gear 104 respectively. As shown in FIG. 7, the developing roller support member 125, the supply roller support member 126 and the input gear support member 127 are arranged next to each other in a triangle on the first cover portion 123. That is, the developing roller support member 125 is arranged at a front side of the first cover portion 123, and the supply roller support member 126 is arranged at a lower rear side with respect to the developing roller support member 125, and the input gear support member 127 is arranged at an upper rear side with respect to the developing roller support member 125 and at an upper side with respect to the supply roller support member 126.

As shown in FIG. 7, three mounting portions 129*a*, 129*b*, 129*c* are formed at a peripheral end of the first cover portion 123. The mounting portion 129*a* is formed at a lower end of the developing roller support member 125. The mounting portion 129*b* is formed at an upper end of the input gear support member 127. The mounting portion 129*c* is formed at a side end between the supply roller support member 126 and the input gear support member 127.

Therefore, the developing roller support member 125, the supply roller support member 126 and the input gear support member 127 are arranged in the vicinity of lines connecting the adjacent mounting portions 129*a*, 129*b*, 129*c*.

As shown in FIG. 9A, the developing roller support member 125 is arranged in the vicinity of a line connecting the mounting portions 129*b* and 129*a*. The supply roller support member 126 is arranged in the vicinity of a line connecting the mounting portions 129*a* and 129*c*. The input gear support member 127 is arranged in the vicinity of a line connecting the mounting portions 129*c* and 129*b*.

The mounting portions 129*a*, 129*b*, 129*c* correspond to the screw portions 110*a*, 110*b*, 110*c* that are arranged in the side wall 81*a*, respectively.

As shown in FIG. 9B, a first side portion 124*a*, 124*b* is formed along a peripheral end of the first cover portion 123. The first side portion 124*a* is extended from the mounting portion 129*b* to an upper side of the developing roller support member 125 and positioned at an upper front side. The first side portion 124*b* is extended from the mounting portion 129*c* to the mounting portion 129*a* and positioned at a lower rear side.

The first side portion 124*a*, 124*b* is bent vertically from a peripheral portion of the first cover portion 123 to one side wall 81*a* of the housing 81. When the gear holder 121 is mounted on the side wall 81*a*, a free end of the first side portion 124*a*, 124*b* contacts the side wall 81*a*.

A plurality of bent portions 133, where two surfaces are connected to each other, are formed along the peripheral end of the first cover portion 123. Three bent portions 133 are formed on the first side portion 124*a* at the upper front side and two bent portions 133 are formed on the first side portion 124*b* at the lower rear side.

The mounting portions 129*a*, 129*b*, 129*c* are formed at the peripheral end of the first cover 123 so as to be shaped in a U-shape seen from a side. The mounting portions 129*a*, 129*b*, 129*c* are formed to be open outside to a same position as the free end portion of the first side portion 124 and recessed toward the side wall 81*a*. A screw hole 131*a*, 131*b*, 131*c* is formed on a flat bottom of the recessed portion respectively.

A step is formed between the mounting portion 129*a*, 129*b*, 129*c* and the first cover portion 123 and the mounting portion 129*a*, 129*b*, 129*c* is arranged much closer to the side wall 81*c*.

As shown in FIGS. 2, 3, 9B, the receiving portion 132*a* is rectangular seen from a front side. The receiving portion 132*a* is extended from the front end of the mounting portion 129*b* toward inside so that the extended end of the receiving portion 132*a* is overlapped with one end of the roller portion 34*b* of the developing roller 34 in the radial direction of the roller portion 34*b*.

As shown in FIGS. 7, 9A, 9B, the second cover 134 is formed continuously from the first cover 122 between the mounting portions 129*b* and 129*c*. A step is formed between the first cover 122 and the second cover 134.

The second cover 134 includes a second cover portion 135 and a second side portion 136 that are integrally formed with each other. The second cover portion 135 corresponds to the idle gear 105. The second side portion 136 is extended from a peripheral portion of the second cover portion 135 toward the side wall 81*a*.

The second cover portion 135 is a flat plate and formed in a circle as seen from a side so as to cover the idle gear 105. As shown in FIG. 9B, a pin 137 and an idle gear guide 138 are formed on a rear side of the second cover portion 135.

As shown in FIG. 8B, the second side portion 136 is vertically bent at a peripheral end of the second cover portion 135 toward the side wall 81*a* and its free end is extended to cover an outer peripheral surface of the second gear tooth 118*b* of the idle gear 105.

As shown in FIG. 9B, the second side portion 136 is formed continuously over the peripheral end of the second cover portion 135 and the two ends of the second side portion 136 are formed continuously with the first side portion 124*a*, 124*b* respectively. A portion where the second cover portion 135 is connected to the first side portion 124*a*, 124*b* is a bent portion 133 where two surfaces are connected.

As shown in FIG. 8B, the pin 137 is extended from a center on the rear surface of the second cover portion 135 to the free end of the second side portion 136 corresponding to the idle gear boss 91.

The idle gear guide 138 is formed in a ring corresponding to the inner surface of the second gear tooth 118*b* of the idle gear 105 on the rear surface of the second cover portion 135 and is extended to a position corresponding to the second gear tooth 118*b* of the idle gear 105.

As shown in FIGS. 6A, 7, the mounting portions 129*a*, 129*b*, 129*c* of the gear holder 121 correspond to the screw portions 110*a*, 110*b*, 110*c* respectively to insert the screw 130*a*, 130*b*, 130*c* to the screw hole 131*a*, 131*b*, 131*c* respectively. Thus, the gear holder 121 is mounted on the side wall 81*a*.

A mounting method will be explained.

As shown in FIGS. 8A, 8B, the shaft end portion, that is extended from the developing roller drive gear 102 of the roller shaft 34*a* of the developing roller 34 to the outside in its axial direction, is inserted into the collar member 128 that is fitted onto the developing roller support member 125. Then, the roller shaft 34*a* is supported rotatably by the developing roller support member 125 via the collar member 128.

As shown in FIGS. 8A, 8C, the shaft end portion of the shaft insertion portion 112 of the supply roller drive gear 103, that is outside in its axial direction, is inserted into the supply roller support member 126. This restricts the axial movement of the supply roller drive gear 103 with respect to the roller shaft 33*a* of the supply roller 33 and the roller shaft 33*a* is rotatably supported by the supply roller support member 126 via the supply roller drive gear 103.

As shown in FIGS. 8B, 8C, the input portion 116 of the input gear 104 is inserted into the input gear support member 127. This restricts the axial movement of the input gear 104 with respect to the input gear boss 86 and the input gear 104 is directly rotatably supported by the input gear support member 127.

As shown in FIG. 8B, the pin 137 of the second cover 134 corresponds to the idle gear boss 91 to insert the pin 137 to the idle gear boss 91.

This restricts the rotation of the gear holder 121 with respect to the side wall 81*a* and the mounting portion 129*a*, 129*b*, 129*c* corresponds to the screw portion 110*a*, 110*b*, 110*c* respectively. Afterwards, the screw 130*a*, 130*b*, 130*c* is inserted to the screw hole 131*a*, 131*b*, 131*c* respectively.

In the first cover 122, the developing roller drive gear 102, the supply roller drive gear 103 and the input gear 104 are covered by the first cover portion 123 from the side and are covered by the first side portions 124*a*, 124*b* from the upper front side and the lower rear side.

At a lower front side of one end of the roller portion 34*b* in its axial direction, the receiving portion 132*a* is arranged with a predetermined distance from the one end of the roller portion 34*b*.

In the second cover 134, the pin 137 is inserted to the idle gear boss 91, as shown in FIG. 8B. This restricts the axial movement of the idle gear 105 with respect to the idle gear boss 91. In this condition, the idle gear 105 is covered by the second cover portion 135 from the side and covered by the second side portion 136 from the outer peripheral side.

As shown in FIGS. 6B, 8A, in the developing cartridge 29, a shaft receiving member 139 is arranged in the side wall 81*b* that is an opposite side to the side wall 81*a* where the gear holder 121 is arranged. The shaft receiving member 139 supports the other end of the roller shaft 34*a* of the developing roller 34 and the other end of the roller shaft 33*a* of the supply roller 33.

The shaft receiving member 139 is a flat plate of conductive resin where carbon particles are mixed. The shaft receiving member 139 includes a developing roller shaft receiving member 140, a supply roller shaft receiving member 141 and a receiving portion 132*b* (see FIG. 3) that are integrally formed with each other. The developing roller shaft receiving member 140 supports the other end of the roller shaft 34*a* of the developing roller 34, and the supply roller shaft receiving member 141 supports the other end of the roller shaft 33*a* of the supply roller 33.

The developing roller shaft receiving member 140 is formed in a circular opening at a front end portion of the shaft receiving member 139. An electricity supply member 142 is formed around the opening integrally therewith. The electricity supply member 142 is cylindrically extended from the front and rear surfaces of the shaft receiving member 139.

The supply roller shaft receiving member 141 is formed in a circular opening at a lower diagonal rear side of the developing roller shaft receiving member 140 of the shaft receiving member 139. The periphery of the opening is extended in a ring from the rear surface of the shaft receiving member 139.

As shown in FIGS. 3, 6B, the receiving portion 132*b* is rectangular as seen from the front side and extended from the lower side of the front end to the inside. The receiving portion 132*b* is extended to the other end of the roller portion 34*b* of the developing roller 34 in its axial direction.

Three hook-shaped engaging members 143 for engaging with the side wall 81*b* are arranged at an upper end and a rear end of the shaft receiving member 139. Two engaging members 143 are shown in FIG. 6B.

A screw hole (not shown) is formed at a lower side between the developing roller receiving member 140 and the supply roller shaft receiving member 141. A screw 144 is inserted to the screw hole.

As shown in FIGS. 6B, 8A, the engaging member 143 of the shaft receiving member 139 is engaged to the cutaway portion 111 and the screw 144 is inserted to the screw hole to screw to the side wall 81*b*. Accordingly, the shaft receiving member 139 is mounted on the side wall 81*b*.

During the mounting operation, as shown in FIG. 8A, the other end of the roller shaft 34*a* of the developing roller 34 is inserted into the electricity supply member 142 of the developing roller receiving member 140 and the electricity supply member 142 is supported by the developing roller receiving member 84*b*. At this time, the developing roller 34 is rotatable.

The shaft end, that is extended further outside from the supply roller insertion member 85*b* where the roller shaft 33*a* of the supply roller 33 is mounted, is inserted to the supply roller shaft receiving member 141. Thus, the other end of the roller shaft 33*a* of the supply roller is supported rotatably by the supply roller shaft receiving member 141.

The receiving portion 132*b* is arranged with a predetermined distance from the other end of the roller portion 34*b* so as to correspond to the other end of the roller portion 34*b* at a lower front side of the other side of the roller portion 34*b*.

After the developing cartridge 29 is mounted in the drum frame 27, the process unit 22 is mounted in the casing 2. Then, the coupling member 146 that is arranged in the casing 2 side is fitted to the input portion 116 of the input gear 104 from its axial direction so as not to be rotated relatively, as shown in FIG. 8B. The coupling member 146 is inserted into the input portion 116 via the input gear support member 127 that is arranged on the gear holder 121.

Power from the motor (not shown) is input to the input gear 104 via the coupling member 146. Then, as shown in FIG. 7, the input gear 104 is rotated in a counterclockwise direction as shown by the arrow and the developing roller drive gear 102, that is interlocked with the input gear 104, and the supply roller drive gear 103 are rotated in a clockwise direction as shown by the arrows. Thus, the developing roller 34 and the supply roller 33 are rotated in the clockwise direction shown by the arrows, as shown in FIG. 2.

As shown in FIG. 7, the second gear tooth 118*b* that is interlocked with the input gear 104 is rotated in the clockwise direction shown by the arrow. That is, the first gear tooth 118*a* is also rotated in the clockwise direction shown by the arrow. The agitator drive gear 106 that is interlocked with the first gear tooth 118*a* is rotated in the counterclockwise direction shown by the arrow. Accordingly, the agitator 36 is rotated in the counterclockwise direction shown by the arrow as shown in FIG. 2.

The input gear 104 includes a helical gear tooth, and the developing roller drive gear 102 that is interlocked with the input gear 104, the supply roller drive gear 103 and the second gear 119*b* also include a helical gear tooth.

Thrust force that is generated with respect to the input gear 104 by interlocking the helical gear teeth with each other functions toward the outside in the axial direction of the input gear 104.

Thrust force that is generated with respect to the developing roller drive gear 102, the supply roller drive gear 103 and the second gear tooth 118*b* by interlocking the helical gear teeth with each other functions toward the inside in the axial direction of each gear.

When the developing cartridge 29 is mounted in the drum frame 27 and the process unit 22 is mounted in the casing 2, an electrode plate 145 that is arranged on the casing 2 contacts the end surface of the electricity supply member 142, as shown in FIG. 8A. Bias from developing bias applying electric source (not shown) is applied to the roller shaft 34*a* of the developing roller 34 via the electricity supply member 142 from the electrode plate 145.

As explained above, in the developing cartridge 29 of this embodiment, the supply roller 33 and the input gear 104 are supported only by the gear holder 121. In the gear holder 121, the roller shaft 34*a* of the developing roller 34 is supported by the developing roller support member 125 via the collar member 128. The roller shaft 33*a* of the supply roller 33 is supported by the supply roller support member 126 via the supply roller drive gear 103. The input portion 116 of the input gear 104 is supported by the input gear support member 127.

Therefore, the relative positions of the developing roller drive gear 102, the supply roller drive gear 103 and the input gear 104 can be determined with high precision. Therefore, the relative positions of the developing roller 34 and the supply roller 33 can be determined with high precision. Accordingly, the developing roller 34 and the supply roller 33 are driven stably and the contact condition of the developing roller 34 and the supply roller 33 is also stable. Therefore, the developing roller 34 and the supply roller 33 are rotated stably and the density of the images is stable. Accordingly, the image quality is improved.

The supply roller support member 126 supports the roller shaft 33*a* of the supply roller 33 via the supply roller drive gear 103. That is, since the supply roller support member 126 directly supports the supply roller drive gear 103, the position of the supply roller drive gear 103 is determined with high precision and the supply roller 33 is driven stably.

The developing roller support member 125 supports the roller shaft 34*a* of the developing roller 34 via the collar member 128. Even if the gear holder 121 is made of a material that is easily scraped by sliding, the roller shaft 34*a* of the developing roller 34 is rotated stably at a correct position for a long time by forming the collar member 128 of a material that has good slidability and is difficult to scrape.

When the gear holder 121 is mounted, the gear holder 121 is positioned based on the developing roller support member 125 as a center reference. Therefore, the other gears are positioned relatively based on the developing roller drive gear 102 as a center reference and the developing roller 34 is driven stably.

By inserting the pin 137 of the second cover 134 into the idle gear boss 91, the rotation of the gear holder 121 is restricted and the mounting position of the gear holder 121 is fixed accurately. Therefore, the other gears are positioned accurately based on the developing roller drive gear 102 as a center reference.

The input portion 116 of the input gear 104 is inserted into the input gear support member 127 and the coupling member 146 is fitted into the input portion 116. That is, power from the motor (not shown) is transferred to the input portion 116 by connecting the coupling member 146 to the input portion 116 via the input support member 127. The relative positions of the other gears with respect to the input gear 104 are maintained with high precision and the other gears are driven accurately.

The gear holder 121 is mounted on an outer side of the side wall 81*a* of the housing 81 and protects the developing roller drive gear 102, the supply roller drive gear 103, the input gear 104 and the idle gear 105. Therefore, the relative position of each gear is maintained with high precision and the gears are surely prevented from being damaged.

In the first cover 122 of the gear holder 121, the first cover portion 123 covers the developing roller drive gear 102, the supply roller drive gear 103 and the input gear 104 from the side and the first side portion 124*a*, 124*b* covers developing roller drive gear 102, the supply roller drive gear 103 and the input gear 104 from the upper front side and the lower rear side.

In the second cover 134, the second cover portion 135 covers the idle gear 105 from the side and the second side portion 136 covers the idle gear 105 from the peripheral side.

Rigidity of the gear holder 121 is increased by the first cover portion 123, the first side portion 124*a*, 124*b*, the second cover portion 135 and the second side portion 136.

Each gear is protected from the side and the peripheral side by the first cover portion 123 and the first side portion 124*a*, 124*b*, or by the second cover portion 135 and the second side portion 136. Therefore, each gear is surely prevented from being damaged.

In the first side portion 124*a*, 124*b* and the second side portion 136, two continuous surfaces are formed so as to hold the bent portion 133 therebetween. Therefore, suppose the first cover portion 123 or the second cover portion 135 is considered as one surface, a top portion of the gear holder 121 includes three surfaces including the continuous two surfaces and the first cover portion 123 or the second cover portion 135. Therefore, rigidity of the gear holder 121 is increased and each gear is surely prevented from being damaged.

The gear holder 121 is surely mounted on the side wall 81*a* of the housing 81 via a plurality of mounting portions 129*a*, 129*b*, 129*c*.

The mounting portion 129*a*, 129*b*, 129*c* is formed by forming a step from the surface of the first cover portion 123. The mounting portion 129*a*, 129*b*, 129*c* is arranged closer to the side wall 81*a* with respect to the first cover portion 123. Accordingly, the screw 130*a*, 130*b*, 130*c* that is mounted in the mounting portion 129*a*, 129*b*, 129*c* is not extended from the first cover portion 123.

The screw 130*a*, 130*b*, 130*c* is mounted in the mounting portion 129*a*, 129*b*, 129*c* at a position closer to the side wall 81*a* of the housing 81 with respect to the first cover portion 123. Therefore, the gear holder 121 is surely mounted in the housing 81.

The developing roller support member 125 is arranged in the vicinity of a line connecting the adjacent mounting portions 129*a*, 129*b* at a periphery of the first cover portion 123 of the gear holder 121. The supply roller support member 126 is arranged in the vicinity of a line connecting the adjacent mounting portions 129*a*, 129*c*. The input gear support member 127 is arranged in the vicinity of a line connecting the adjacent mounting portions 129*b*, 129*c*.

Accordingly, the relative positions of the developing roller drive gear 102, the supply roller drive gear 103 and the input gear 104 are maintained with high accuracy and are arranged in a small space and the gear holder 121 is surely mounted in the housing 81.

The receiving portion 132*a* that is integrally formed with the gear holder 121 and the receiving portion 132*b* that is integrally formed with the shaft receiving member 139 are arranged corresponding to each other with a predetermined distance from the two ends of the roller portion 34*b* at a lower front side of the two ends of the roller portion 34*b*. Even if toner leaks from the two ends of the roller portion 34*b* of the developing roller 34, toner is prevented from being scattered from the developing cartridge 29 because the leaked toner is received by the receiving portion 132*a*, 132*b*.

Since the other end of the roller shaft 34*a* of the developing roller 34 and the other end of the roller shaft 33*a* of the supply roller 33 are supported by the common shaft receiving member 139 on the side wall 81*b* of the developing cartridge 29, the relative positions of the roller shaft 34*a* and the roller shaft 33*a* are determined with high accuracy.

Therefore, the relative positions of the developing roller 34 and the supply roller 33 are surely determined by the shaft receiving member 139 and the gear holder 121 from the two ends in its axial direction, and the developing roller 34 and the supply roller 33 are driven stably.

Since the shaft receiving member 139 is made of a conductive material, developing bias is applied to the developing roller 34 via the shaft receiving member 139 when the developing cartridge 29 is mounted in the casing 2 and the electrode plate 145 that is arranged on the casing 2 contacts the electricity supply member 142 that is a part of the shaft receiving member 139.

The input gear 104 where power is input, the developing roller drive gear 102, the supply roller drive gear 103 and the second gear tooth 118*b* are connected by interlocking the helical tooth. Accordingly, the driving force is surely transferred and the developing roller 34 and the supply roller 33 are driven stably.

Because the thrust force, that is generated by the connection of the helical tooth with respect to the developing roller drive gear 102, the supply roller drive gear 103 and the second gear tooth 118*b*, functions toward the side wall 81*a* of the housing 81, the gears do not press the gear holder 121. Therefore, the gear holder 121 is prevented from being damaged or coming off of the housing 81.

The thrust force that is generated with respect to the input gear 104 functions toward the gear holder 121. However, the thrust force does not influence the gear holder 121.

In the laser printer 1 including the developing cartridge 29, the developing roller 34 and the supply roller 33 are driven stably and the image quality is improved.

While the invention has been described in detail and with reference to the specific embodiments thereof, it would be apparent to those skilled in the art that various changes, arrangements and modifications may be applied therein without departing from the spirit and scope of the invention.

In the above embodiment, the roller shaft 34*a* of the developing roller 34 is supported by the developing roller support member 125 via the collar member 128. The roller shaft 34*a* may be supported directly by the developing roller support member 125. The roller shaft 34*a* may be supported by the developing roller support member 125 via the developing roller gear 102.

In the above embodiment, the roller shaft 33*a* of the supply roller 33 is supported by the supply roller support member 126 via the supply roller drive gear 103. The roller shaft 33*a* may be directly supported by the roller support member 126. The roller shaft 33*a* may be supported by the supply roller support member 126 via the collar member 128.

In the above embodiment, the coupling member 146 is fitted to the input gear 104 for inputting the driving force. The coupling member 146 may be fitted to the developing roller drive gear 102 or the supply roller drive gear 103. In this case, a connection hole is formed on the gear holder 121 for connecting the coupling member 146. The connection hole is formed at a position of the gear holder 121 corresponding to the shaft hole 107 of the developing roller drive gear 102 or the shaft insertion portion 112 of the supply roller drive gear 103.

In the above embodiment, the developing roller drive gear 102 and the supply roller drive gear 103 are interlocked simultaneously so as to rotate the developing roller drive gear 102 and the supply roller drive gear 103 in the same direction.

An idle gear may be arranged between the input gear 104 and one of the developing roller drive gear 102 and the supply roller drive gear 103. One of the developing roller drive gear 102 and the supply roller drive gear 103 is directly interlocked with the input gear 104 so as to rotate in an opposite direction to the input gear 104. The other one of the developing roller drive gear 102 and the supply roller drive gear 103 receives driving force from the input gear 104 via the idle gear so as to rotate in the same direction as the input gear 104.

Then, each of the developing drive gear 102 and the supply roller drive gear 103 is rotated in an opposite direction.

In this case, the gear holder 121 is preferably formed so that the idle gear is also supported by the gear holder 121.

What is claimed is:

1. A developing cartridge, comprising:

a frame including opposing side walls, each of the opposing side walls having an outer surface and an inner surface;

a developing roller including a developing roller body and a developing roller shaft;

a supply roller that supplies a developing agent to the developing roller, the supply roller including a supply roller body and a supply roller shaft, the developing roller shaft and the supply roller shaft being inserted into respective openings formed in the inner surfaces and the outer surfaces such that the developing roller body and the supply roller body are positioned between the inner surfaces;

a developing roller drive gear, provided at the developing roller shaft on the outer surface of one of the opposing side walls of the frame;

a supply roller drive gear, provided at the supply roller shaft on the outer surface of the one of the opposing side walls of the frame;

an input gear that engages the developing roller drive gear and the supply roller drive gear; and a holder integrally formed with a first support that supports the developing roller shaft, a second support that supports the supply roller shaft and a third support that supports the input gear, the holder being mounted on the outer surface of the one of the opposing side walls of the frame to at least partially cover the developing roller drive gear, the supply roller drive gear and the input gear, wherein the holder further comprises a developing agent receiving portion that extends away from a remainder of the gear holder to a position opposed to the developing roller.

2. The developing cartridge of claim 1, wherein the first support comprises an opening in the holder.

3. The developing cartridge of claim 1, wherein the second support comprises an opening in the holder.

4. The developing cartridge of claim 1, wherein:

the developing roller drive gear, the supply roller drive gear, and the holder are all located on a first side of the frame; and no gears are located on a second side of the frame opposite the first side of the frame.

5. The developing cartridge of claim 1, further comprising a first collar provided at the developing roller shaft, wherein the first support comprises the first collar.

6. The developing cartridge of claim 5, wherein the first collar is detachably fitted to the holder.

7. The developing cartridge of claim 5, wherein the first collar is detachably fitted to the developing roller shaft.

8. The developing cartridge of claim 1, wherein the holder is formed with a mounting portion so that the holder is screwed to the frame via the mounting portion.

9. The developing cartridge of claim 1, wherein the developing agent receiving portion extends from the holder in an axial direction of the developing roller to at least partially overlap an end portion of the developing roller body.

10. The developing cartridge of claim 9, wherein the receiving portion at least partially overlaps the end portion of the developing roller body in a radial direction of the developing roller.

11. The developing cartridge of claim 1, further comprising a shaft receiving element formed with a fourth support and a fifth support, the shaft receiving element being provided at the outer surface of the frame opposite from the outer surface where the holder is mounted, the fourth support supporting the developing roller shaft and the fifth support supporting the supply roller shaft.

12. The developing cartridge of claim 11, wherein the shaft receiving element is made of electrically conductive material.

* * * * *